US008851641B2

(12) United States Patent
Kamiyama

(10) Patent No.: US 8,851,641 B2
(45) Date of Patent: Oct. 7, 2014

(54) LIQUID-DISCHARGING DEVICE, LIQUID STIRRING METHOD, AND LIQUID FILLING METHOD

(71) Applicant: Seiko Epson Corporation, Tokyo (JP)

(72) Inventor: Nobuaki Kamiyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 13/787,942

(22) Filed: Mar. 7, 2013

(65) Prior Publication Data

US 2013/0235100 A1 Sep. 12, 2013

(30) Foreign Application Priority Data

Mar. 7, 2012 (JP) ..... 2012-050739

(51) Int. Cl.
*B41J 2/175* (2006.01)
*B41J 2/18* (2006.01)

(52) U.S. Cl.
CPC ..... *B41J 2/17503* (2013.01); *B41J 2/17509* (2013.01); *B41J 2/175* (2013.01)
USPC ..... 347/85; 347/89

(58) Field of Classification Search
CPC .... B41J 2/175; B41J 2/17596; B41J 2/17509; B41J 2/18
USPC ..... 347/6, 84, 85, 89
See application file for complete search history.

(56) References Cited

U.S. PATENT DOCUMENTS 6,000,792 A 12/1999 Koizumi et al.
7,399,075 B2 * 7/2008 Nomura et al. ..... 347/89

FOREIGN PATENT DOCUMENTS

JP 06-079876 A 3/1994

* cited by examiner

*Primary Examiner* — An Do
(74) *Attorney, Agent, or Firm* — Global IP Counselors, LLP

(57) ABSTRACT

A liquid ejection device includes a head section, a first liquid reservoir section, a supply passage, a second liquid reservoir section, an outgoing passage that sends liquid from the first liquid reservoir section to the second liquid reservoir section and includes a shared passage shared with the supply passage, a return passage that sends the liquid from the second liquid reservoir section to the first liquid reservoir section, and a controller. After the controller performs a stirring process of stirring the liquid by causing the liquid in the first liquid reservoir section to pass through the outgoing passage and subsequently causing the liquid in the second liquid reservoir section to pass through the return passage, the controller performs a process of flowing out a part of the liquid in the first liquid reservoir section toward the shared passage.

11 Claims, 11 Drawing Sheets

LIQUID-DISCHARGING DEVICE, LIQUID STIRRING METHOD, AND LIQUID FILLING METHOD

CROSS-REFERENCE TO RELATED APPLICATIONS

This application claims priority to Japanese Patent Application No. 2012-050739 filed on Mar. 7, 2012, which is hereby incorporated by reference herein in its entirety.

BACKGROUND

1. Technical Field

The present invention relates to a liquid-discharging device, a liquid stirring method, and a liquid filling method.

2. Related Art

As an example of a liquid-discharging device, an ink-jet printer has been known in which liquid such as ink is discharged onto various kinds of mediums such as paper or a film and an image is printed. Such an ink-jet printer has a reservoir section that stores liquid, a head section that discharges liquid onto a medium, or a flow passage through which liquid flows from the reservoir section to the head section (for example, Japanese Laid-Open Patent Publication No. H06-79876).

SUMMARY

In such a liquid-discharging device, however, there are cases where air (air bubbles) enters the reservoir section. Thus, there are cases where air (air bubbles) flowed out of the reservoir section flows into the head section through the flow passage when liquid is supplied from the reservoir section to the head section. This air might cause a dead pixel when the head section discharges liquid, and cause deterioration in a printed image.

The present invention has been made to address the above-described circumstances, and an object of the present invention is to prevent air (air bubbles) from entering when liquid is supplied to the head section.

A liquid-discharging device according to one aspect includes a head section, a first liquid reservoir section, a supply passage, a second liquid reservoir section, an outgoing passage, a return passage, and a controller. The head section is configured and arranged to discharge liquid onto a medium. The first liquid reservoir section is configured and arranged to store the liquid. The supply passage is configured and arranged to supply the liquid from the first liquid reservoir section to the head section. The second liquid reservoir section is configured and arranged to store the liquid sent out from the first liquid reservoir section and to send the liquid back to the first liquid reservoir section. The outgoing passage is a passage through which the liquid passes when the liquid is sent from the first liquid reservoir section to the second liquid reservoir section. The outgoing passage includes a shared passage that is shared with the supply passage. The return passage is a passage through which the liquid passes when the liquid is sent from the second liquid reservoir section to the first liquid reservoir section. The controller is configured to perform a stirring process of stirring the liquid by causing the liquid in the first liquid reservoir section to pass through the outgoing passage so as to be sent toward the second liquid reservoir section and subsequently causing the liquid in the second liquid reservoir section to pass through the return passage so as to be sent toward the first liquid reservoir section. The controller is configured to perform a process of flowing out a part of the liquid in the first liquid reservoir section toward the shared passage after performing the stirring process.

Other aspects of the present invention will be specified with the description of the present specification and the attached drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
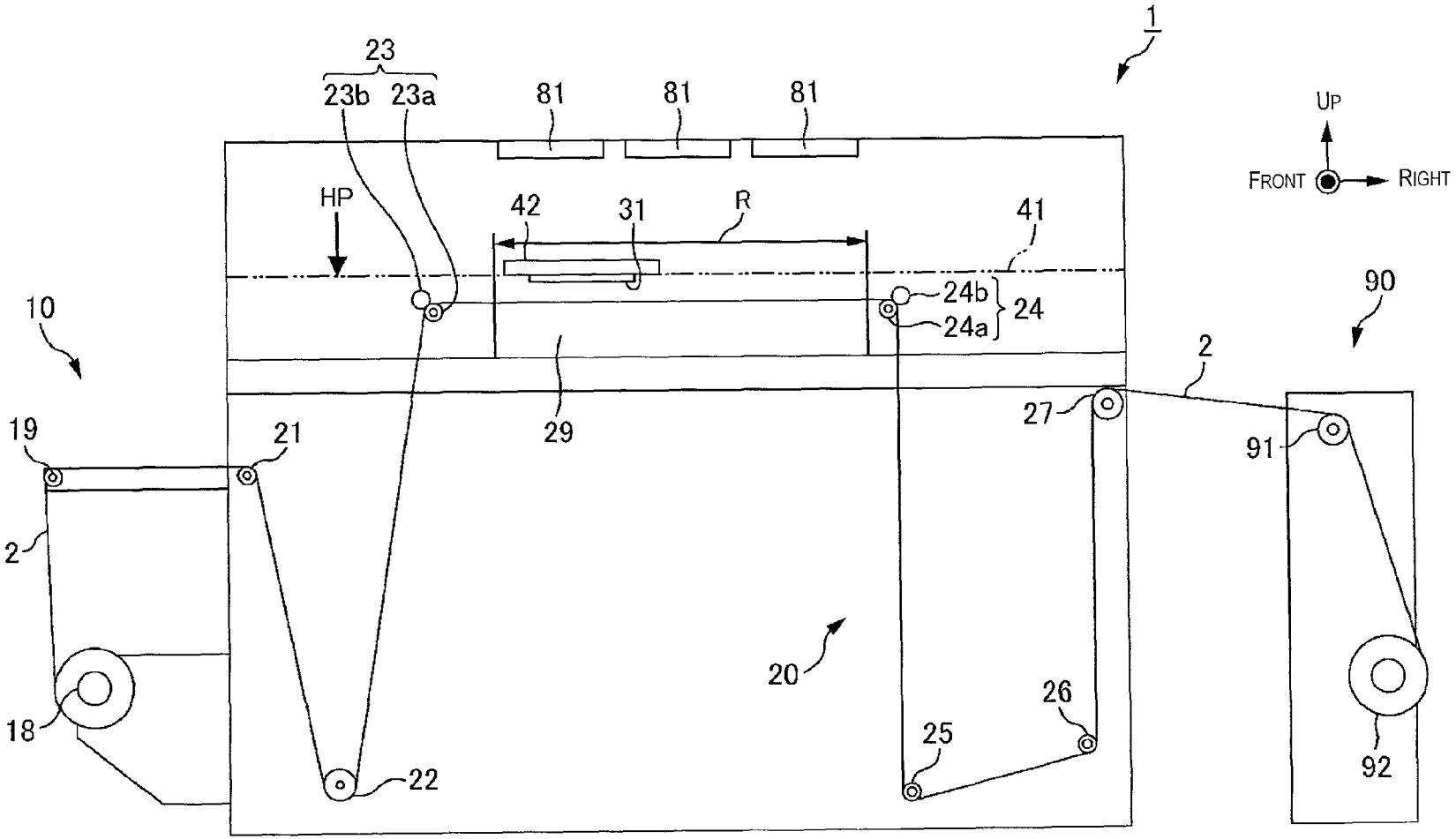
FIG. 1 is a schematic diagram that illustrates a configuration of a printer 1.

At least the following matter will be specified with the description of the present specification and the attached drawings.

A liquid-discharging device according to an embodiment includes a head section, a first liquid reservoir section, a supply passage, a second liquid reservoir section, an outgoing passage, a return passage, and a controller. The head section is configured and arranged to discharge liquid onto a medium. The first liquid reservoir section is configured and arranged to store the liquid. The supply passage is configured and arranged to supply the liquid from the first liquid reservoir section to the head section. The second liquid reservoir section is configured and arranged to store the liquid sent out from the first liquid reservoir section and to send the liquid back to the first liquid reservoir section. The outgoing passage is a passage through which the liquid passes when the liquid is sent from the first liquid reservoir section to the second liquid reservoir section. The outgoing passage includes a shared passage that is shared with the supply passage. The return passage is a passage through which the liquid passes when the liquid is sent from the second liquid reservoir section to the first liquid reservoir section. The controller is configured to perform a stirring process of stirring the liquid by causing the liquid in the first liquid reservoir section to pass through the outgoing passage so as to be sent toward the second liquid reservoir section and subsequently causing the liquid in the second liquid reservoir section to pass through the return passage so as to be sent toward the first liquid reservoir section. The controller is configured to perform a process of flowing out a part of the liquid in the first liquid reservoir section toward the shared passage after performing the stirring process.

With this liquid-discharging device, air (air bubbles) can be prevented from entering when liquid is supplied to the head section.

In this liquid-discharging device, the controller is preferably configured to flow out the part of the liquid in the first liquid reservoir section toward all the shared passage after performing the stirring process.

With this liquid-discharging device, air (air bubbles) can be prevented from entering more effectively when liquid is supplied to the head section after performing the stirring process.

A liquid stirring method according to an embodiment includes preparing a liquid-discharging device. The liquid discharging device includes a head section, a first liquid reservoir section, a supply passage, a second liquid reservoir section, an outgoing passage, a return passage, and a controller. The head section is configured and arranged to discharge liquid onto a medium. The first liquid reservoir section is configured and arranged to store the liquid. The supply passage is configured and arranged to supply the liquid from the first liquid reservoir section to the head section. The second liquid reservoir section is configured and arranged to store the liquid sent out from the first liquid reservoir section and to send the liquid back to the first liquid reservoir section. The outgoing passage is a passage through which the liquid passes when the liquid is sent from the first liquid reservoir section to the second liquid reservoir section. The outgoing passage includes a shared passage that is shared with the supply passage. The return passage is a passage through which the liquid passes when the liquid is sent from the second liquid reservoir section to the first liquid reservoir section. The method further includes: performing, by the controller, a stirring process of stirring the liquid by causing the liquid in the first liquid reservoir section to pass through the outgoing passage so as to be sent toward the second liquid reservoir section and subsequently causing the liquid in the second liquid reservoir section to pass through the return passage so as to be sent toward the first liquid reservoir section; and performing, by the controller, a process of flowing out a part of the liquid in the first liquid reservoir section toward the shared passage after the performing of the stirring process.

With this liquid stirring method, air (air bubbles) can be prevented from entering when liquid is supplied to the head section.

A liquid-discharging device according to an embodiment includes a head section, a supply passage, a second liquid reservoir section, an outgoing passage, a return passage, and a controller. The head section is configured and arranged to discharge liquid onto a medium. The first liquid reservoir section is configured and arranged to store the liquid. The supply passage is configured and arranged to supply the liquid from the first liquid reservoir section to the head section. The second liquid reservoir section is configured and arranged to store the liquid sent out from the first liquid reservoir section and to send the liquid back to the first liquid reservoir section. The outgoing passage is a passage through which the liquid passes when the liquid is sent from the first liquid reservoir section to the second liquid reservoir section. The return passage is a passage through which the liquid passes when the liquid is sent from the second liquid reservoir section to the first liquid reservoir section. The return passage includes a shared passage that is shared with the supply passage. The controller is configured to perform a filling process including a first process of filling the outgoing passage with the liquid by causing the liquid in the first liquid reservoir section to pass through the outgoing passage so as to be sent toward the second liquid reservoir section, a second process of causing the liquid stored in the second liquid reservoir section in the first process to pass through the return passage so as to be sent toward the first liquid reservoir section, a third process of causing the liquid in the first liquid reservoir section to pass through the outgoing passage once again so as to be sent toward the second liquid reservoir section, and a fourth process of filling the return passage with the liquid by causing the liquid stored in the second liquid reservoir section in the third process to pass through the return passage so as to be sent toward the first liquid reservoir section.

With this liquid-discharging device, air can be prevented from entering when liquid is supplied to the head section.

A liquid filling method according to an embodiment includes preparing a liquid-discharging device. The liquid-discharging device includes a head section, a supply passage, a second liquid reservoir section, an outgoing passage, a return passage, and a controller. The head section is configured and arranged to discharge liquid onto a medium. The first liquid reservoir section is configured and arranged to store the liquid. The supply passage is configured and arranged to supply the liquid from the first liquid reservoir section to the head section. The second liquid reservoir section is configured and arranged to store the liquid sent out from the first liquid reservoir section and to send the liquid back to the first liquid reservoir section. The outgoing passage is a passage through which the liquid passes when the liquid is sent from the first liquid reservoir section to the second liquid reservoir section. The return passage is a passage through which the liquid passes when the liquid is sent from the second liquid reservoir section to the first liquid reservoir section. The return passage includes a shared passage that is shared with the supply passage. The method further includes performing a filling process by the controller, the filling process including a first process of filling the outgoing passage with the liquid by causing the liquid in the first liquid reservoir section to pass through the outgoing passage so as to be sent toward the second liquid reservoir section, a second process of causing the liquid stored in the second liquid reservoir section in the first process to pass through the return passage so as to be sent toward the first liquid reservoir section, a third process of causing the liquid in the first liquid reservoir section to pass through the outgoing passage once again so as to be sent toward the second liquid reservoir section, and a fourth process of filling the return passage with the liquid by causing the liquid stored in the second liquid reservoir section in the third process to pass through the return passage so as to be sent toward the first liquid reservoir section.

With this liquid filling method, air (air bubbles) can be prevented from entering when liquid is supplied to the head section.

Embodiments

Configuration Example of Printer 1

Figure 2:
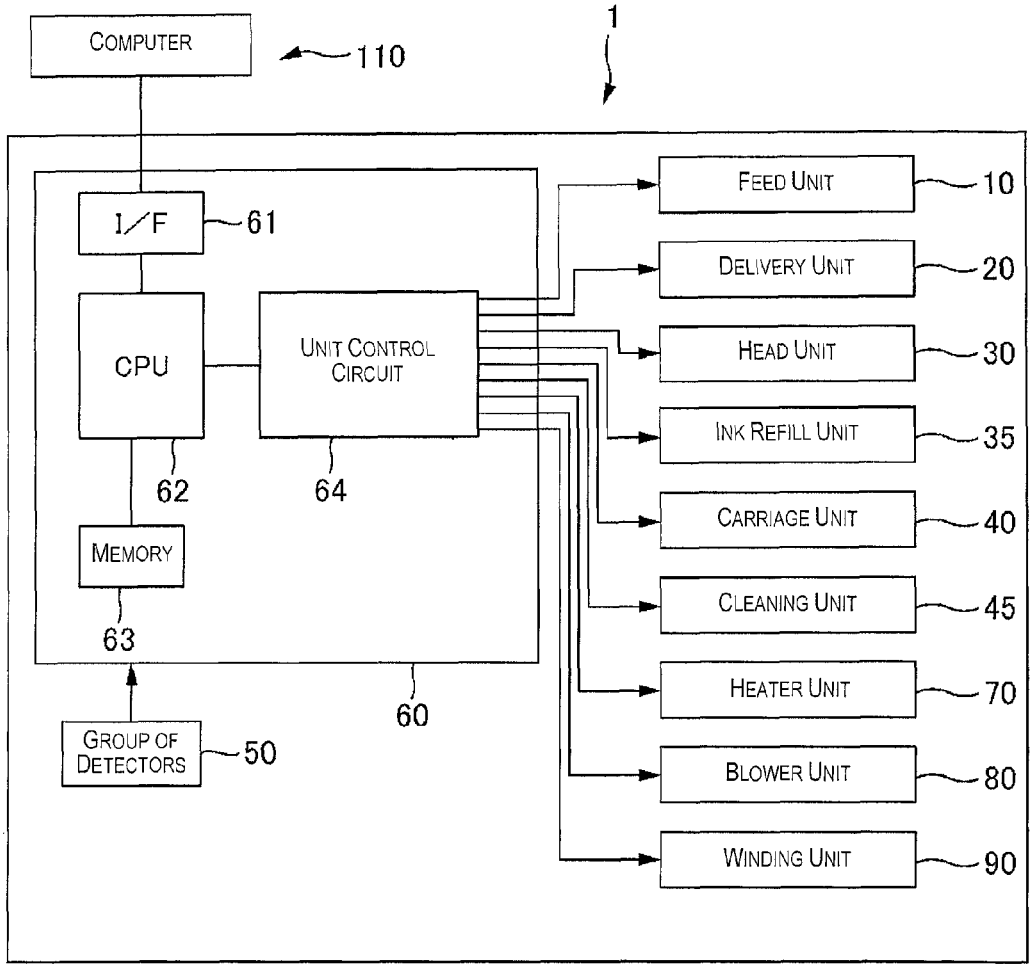
FIG. 2 is a block diagram that illustrates a configuration example of the printer 1.

A configuration example of the printer 1 (in the present embodiment, an ink jet printer, in particular, a lateral scan type label printing machine) as an example of the liquid-discharging device will be described with reference to FIG. 1 and FIG. 2. FIG. 1 is a schematic diagram that illustrates a configuration of the printer 1. FIG. 2 is a block diagram that illustrates a configuration example of the printer 1.

In the following descriptions, "vertical direction" and "horizontal direction" are based on directions shown by arrows in FIG. 1. "Front-back direction" refers to a direction perpendicular to the paper in FIG. 1.

In the present embodiment, paper winded in a roll shape (hereinafter, referred to as "roll paper (continuous paper)") is used as an example a medium on which the printer 1 records an image.

As shown in FIG. 1 and FIG. 2, the printer 1 according to the present embodiment has a delivery unit 20, a feed unit 10, a platen 29, and a winding unit 90. The feed unit 10, the platen 29, and the winding unit 90 are arranged along a delivery route in which the delivery unit 20 delivers roll paper 2 (in FIG. 1, the delivery route is shown by a portion where the roll paper 2 is located between a roll core of roll paper 18 and a roll paper winding drive shaft 92). The printer 1 also has a head unit 30 that performs printing of an image by discharging a plurality of kinds of ink in a print region R on the delivery route, the ink refill unit 35, a carriage unit 40, a cleaning unit 45, a heater unit 70, a blower unit 80 that sends wind to the roll paper 2 on the platen 29, a controller 60 that controls these units and performs the operations as the printer 1, and a group of detectors 50.

The feed unit 10 feeds the roll paper 2 to the delivery unit 20. The feed unit 10 has the roll core of roll paper 18 and a relay roller 19. The roll paper 2 is winded on the roll core of roll paper 18, and the roll core of roll paper 18 is supported in a rotatable manner. The relay roller 19 winds the roll paper 2 reeled out from the roll core of roll paper 18 so as to direct the roll paper 2 to the delivery unit 20.

The delivery unit 20 delivers the roll paper 2 fed by the feed unit 10 along the delivery route set in advance. The delivery unit 20 has a relay roller 21, a relay roller 22, a first delivery roller 23, a second delivery roller 24, a turning roller 25, a relay roller 26, and a sending-out roller 27 as shown in FIG. 1. The relay roller 21 is located horizontally on the right with respect to the relay roller 19. The relay roller 22 is located obliquely downward on the right viewed from the relay roller 21. The first delivery roller 23 is located obliquely upward on the right viewed from the relay roller 22 (on the upstream side in the delivery direction viewed from the platen 29). The second delivery roller 24 is located on the right viewed from the first delivery roller 23 (on the downstream side in the delivery direction viewed from the platen 29). The turning roller 25 is located vertically downward viewed from second delivery roller 24. The relay roller 26 is located on the right viewed from the turning roller 25. The sending-out roller 27 is located upward viewed from the relay roller 26.

The relay roller 21 is a roller that winds the roll paper 2, fed by the relay roller 19, from the left, and loosens downward.

The relay roller 22 is a roller that winds the roll paper, 2 fed by the relay roller 21, from the left, and delivers obliquely upward to the right.

The first delivery roller 23 has a first driving roller 23*a* and a first driven roller 23*b*. The first driving roller 23*a* is driven by a motor that is not shown in the drawing. The first driven roller 23*b* is arranged to face the first driving roller 23*a* such that the roll paper 2 is sandwiched by the first driving roller 23*a* and the first driven roller 23*b*. The first delivery roller 23 pulls up the roll paper 2 that has been loosened downward, and delivers the roll paper 2 to the print region R that faces the platen 29. The first delivery roller 23 is configured to temporarily stop delivering while an image is being printed to part of the roll paper 2 on the print region R. Here, the delivery amount of the roll paper 2 to be placed on the platen 29 is adjusted by rotation of the first driven roller 23*b* in accordance with rotation driving of the first driving roller 23*a* based on driving control of the controller 60.

As described above, the delivery unit 20 has a mechanism that delivers the winded part of the roll paper 2 while loosening downward between the relay rollers 21, 22 and the first delivery roller 23. The looseness of the roll paper 2 is monitored by the controller 60 based on a detection signal from a looseness detection sensor that is not shown in the drawing. More specifically, in a case where the looseness detection sensor detects part of the roll paper 2 loosened between the relay rollers 21, 22 and the first delivery roller 23, it can be said that tension of an adequate magnitude is exerted on the part of the roll paper 2, and thus the delivery unit 20 can deliver the roll paper 2 in a state of being loosened. On the other hand, in a case where the looseness detection sensor does not detect part of the roll paper 2 loosened between the relay rollers 21, 22 and the first delivery roller 23, it can be said that tension of an excessive magnitude is exerted on the part of the roll paper 2. Therefore, the delivery of the roll paper 2 by the delivery unit 20 is temporarily stopped, and the tension is adjusted to have an adequate magnitude.

The second delivery roller 24 has a second driving roller 24*a* and a second driven roller 24*b*. The second driving roller 24*a* is driven by a motor that is not shown in the drawing. The second driven roller 24*b* is arranged to face the second driving roller 24*a* such that the roll paper 2 is sandwiched by the second driving roller 24*a* and the second driven roller 24*b*. The second delivery roller 24 is a roller that delivers part of the roll paper 2, after an image has been recorded by the head unit 30, in the horizontal direction along a supporting surface of the platen 29, and then delivers the part of the roll paper 2 vertically downward. Consequently, the delivery direction of the roll paper 2 is turned. Here, the tension exerted on the part of the roll paper 2 located on the platen 29 is adjusted by rotation of the second driven roller 24*b* in accordance with rotation driving of the second driving roller 24*a* based on driving control of the controller 60.

The turning roller 25 is a roller that winds the roll paper 2, fed by the second delivery roller 24, from the upper left, and delivers obliquely upward to the right.

The relay roller 26 is a roller that winds the roll paper 2, fed by the turning roller 25, from the lower left, and delivers upward.

The sending-out roller 27 winds the roll paper 2, fed by the relay roller 26, from the lower left, and sends out toward the winding unit 90.

The delivery route for delivering the roll paper 2 is formed by causing the roll paper 2 to move sequentially via each roller. The roll paper 2 is delivered by the delivery unit 20 along the delivery route intermittently with respect to each region that corresponds to the print region R.

The head unit 30 is for recording an image on part of the roll paper 2 located in the print region R on the delivery route. Specifically, the head unit 30 forms an image by discharging ink from an ink discharging nozzle to part of the roll paper 2 fed in the print region R (on the platen 29) on the delivery route by the delivery unit 20. In the present embodiment, the head unit 30 has "M" heads 31 ("M" is the number of the heads 31).

Each of the heads 31 has an ink discharging nozzle line in which ink discharging nozzles are aligned in a line direction on the lower surface (that is, a nozzle surface) of the head 31. In the present embodiment, each of the heads 31 has the ink discharging nozzle line made of a plurality of ink discharging nozzles #1-#N provided for each color such as white (W), cyan (C), magenta (M), yellow (Y), or black (K). Each of the ink discharging nozzles #1-#N of each of the ink discharging nozzle lines is aligned linearly in an intersecting direction that intersects with the delivery direction of the roll paper 2 (that is, the intersecting direction is the line direction described above). Each of the ink discharging nozzle lines are arranged in parallel with respect to each other along the delivery direction.

A piezoelectric element is provided in each of the ink discharging nozzles #1-#N as a driving element for discharging ink droplets (the piezoelectric element is not shown in the drawing). When a voltage of predetermined duration is applied between electrodes provided on both ends of the piezoelectric element, the piezoelectric element expands in response to the time of applying the voltage, which causes deformation of a side wall of an ink flow passage. Consequently, the volume of the ink flow passage shrinks in response to expansion and contraction of the piezoelectric element, and ink corresponding to this shrinkage amount is discharged as ink droplets from each of the ink discharging nozzles #1-#N of each color.

Also, the "M" heads 31 are aligned in the intersecting direction (the line direction), which forms the head unit 30. Therefore, the head unit 30 has "M×N" ink discharging nozzles for each color.

The ink refill unit 35 refills the head unit 30 with ink when the ink amount of the head unit 30 decreases due to discharging of ink by the head 31. The head unit 30 (the head 31) can print an image by discharging ink supplied from the ink refill unit 35. The ink refill unit 35 is provided for each color of ink. A specific configuration and the like of the ink refill unit 35 will be described in detail later.

The carriage unit 40 moves the head unit 30 (the head 31). The carriage unit 40 has a carriage guide rail 41, a carriage 42, and a motor that is not shown in the drawing. The carriage guide rail 41 (shown by a two-dot chain line in FIG. 1) extends in the delivery direction (the horizontal direction), and the carriage 42 is supported so as to reciprocate along the carriage guide rail 41 in the delivery direction (the horizontal direction). In the present embodiment, the carriage 42 has four sub carriages, and the plurality of heads 31 are provided for each sub carriage. The carriage 42 is configured to move in the delivery direction (the horizontal direction) integrally with the head unit 30 (the head 31) by driving of the motor that is not shown in the drawing. For cleaning of the head unit 30 (the head 31) after printing of an image, the carriage 42 moves integrally with the head unit 30 (the head 31) along the carriage guide rail 41 to the upstream side of the delivery direction (the upstream side in the delivery direction viewed from the platen 29), and stops at a home position HP where cleaning is performed (see FIG. 1).

The cleaning unit 45 is provided at the home position HP to perform cleaning of the head unit 30 (the head 31). The cleaning unit 45 has a cap, an aspiration pump, and the like, which are not shown in the drawing. It is configured that the cap adheres to the lower surface (the nozzle surface) of the head 31 when the carriage 42 is located at the home position HP. Then, ink inside the head 31 is aspirated together with thickened ink or paper dust when the aspiration pump is operated in a state where the cap adheres. In this manner, a clogged nozzle is recovered from a non-discharge state, and the cleaning of the head is completed.

The platen 29 supports part of the roll paper 2 located in the print region R on the delivery route, and heats the part of the roll paper 2. As shown in FIG. 1, the platen 29 is provided corresponding to the print region, R on the delivery route, and is arranged in a region along the delivery route between the first delivery roller 23 and the second delivery roller 24. The platen 29 can heat the part of the roll paper 2 by receiving supply of heat generated from the heater unit 70.

The heater unit 70 for heating the roll paper 2 has a heater that is not shown in the drawing. The heater has a nichrome wire, and is configured such that the nichrome wire is arranged inside the platen 29 at a uniform distance from the supporting surface of the platen 29. Therefore, the nichrome wire itself generates heat when energized, and the heater can transfer the heat to part of the roll paper 2 located on the supporting surface of the platen 29. Since the heater is configured such that the nichrome wire is embedded all over the platen 29, the heater can transfer the heat uniformly to the part of the roll paper 2 on the platen 29. In the present embodiment, the part of the roll paper 2 is heated uniformly such that the temperature of the part of the roll paper 2 on the platen 29 becomes 45° C. Consequently, ink landed on the part of the roll paper 2 can be dried.

The blower unit 80 is provided for sending wind to the roll paper 2 on the platen 29. The blower unit 80 has a fan 81, and a motor for rotating the fan 81. The motor is not shown in the drawing. The fan 81 sends wind to the roll paper 2 on the platen 29 by rotation, and dries ink landed on the roll paper 2. As shown in FIG. 1, a plurality of fans 81 are provided in a cover disposed in a main body section such that it can be opened or closed. The cover is not shown in the drawing. When the cover is closed, each of the fans 81 is located above the platen 29 so as to face the supporting surface of the platen 29 (the roll paper 2 on the platen 29).

The winding unit 90 is provided for winding the roll paper 2 fed by the delivery unit 20 (roll paper to which an image has already been printed). The winding unit 90 has a relay roller 91 and the roll paper winding drive shaft 92. The relay roller 91 winds the roll paper 2, fed by the sending-out roller 27, from the upper left, and delivers obliquely downward to the right. The roll paper winding drive shaft 92 is supported in a rotatable manner, and winds the roll paper 2 fed by the relay roller 91.

The controller 60 is a control unit that performs control of the printer 1. As shown in FIG. 2, the controller 60 has an interface section 61, a CPU 62, a memory 63, and a unit control circuit 64. The interface section 61 transmits and receives data between a computer 110 as an external device and the printer 1. The CPU 62 is an arithmetic processing unit that controls the entire printer 1. The memory 63 secures an area for storing a program of the CPU 62, a work area, and the like. The CPU 62 controls each unit by using the unit control circuit 64 in accordance with a program stored in the memory 63.

The group of detectors 50 is provided for monitoring a status of the printer 1. For example, the group of detectors 50 includes the above-described looseness detection sensor, a rotary encoder that is attached to the delivery roller and is used for control of delivery or the like of the roll paper 2, a paper detection sensor that detects existence or non-existence of the delivered roll paper 2, a linear encoder that detects the position of the carriage 42 (or the head 31) in the delivery direction (the horizontal direction), a paper end position detection sensor that detects the paper end (edge) position of the roll paper 2 in the width direction.

Ink Refill Unit 35

Figure 3:
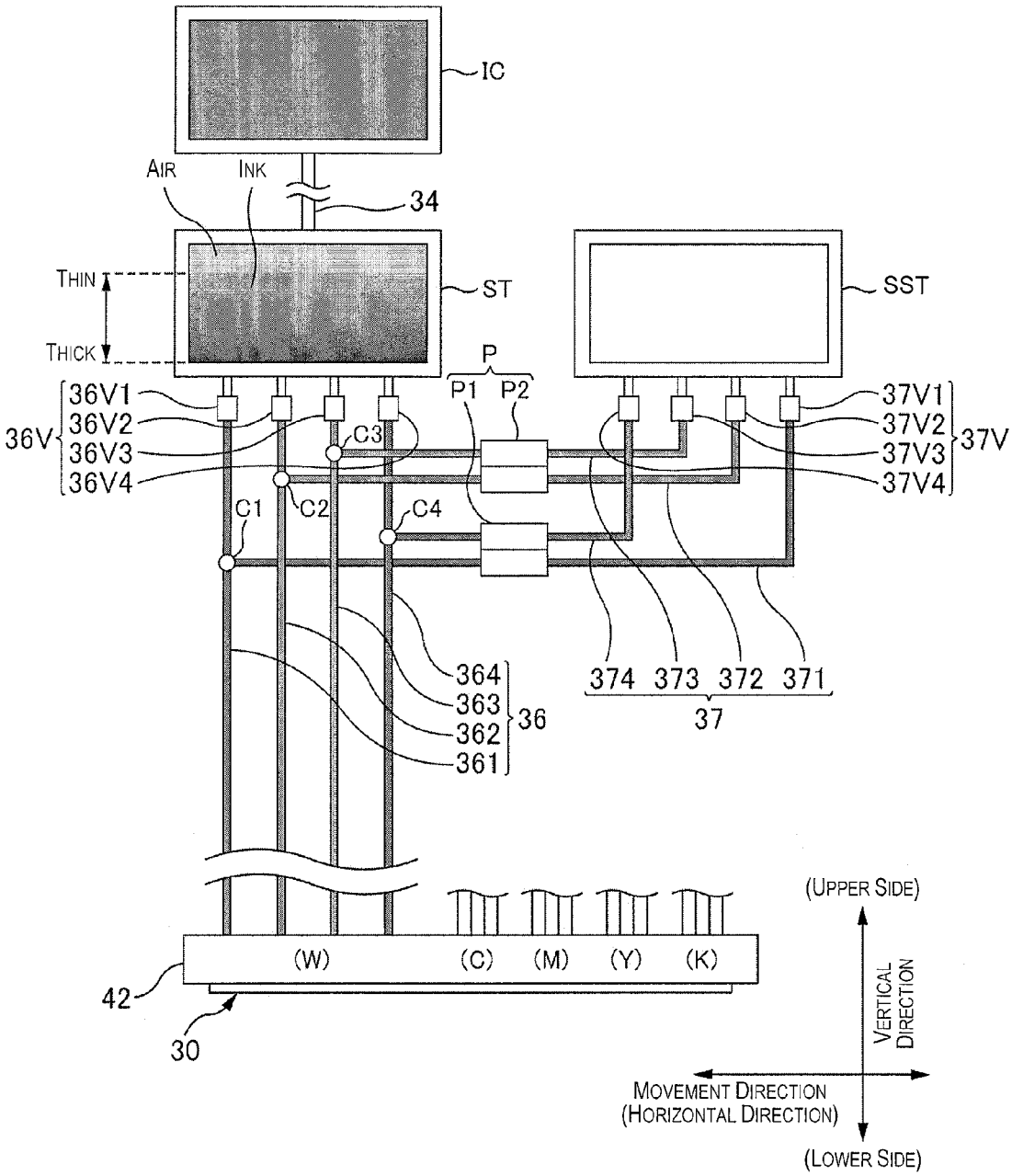
FIG. 3 is a diagram that explains a configuration example of an ink refill unit 35.
Figure 4:
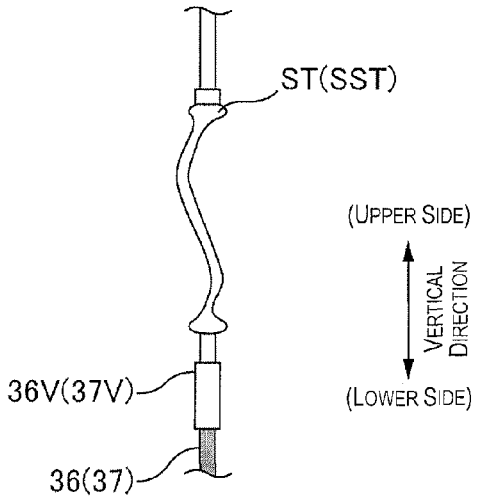
FIG. 4 is a schematic side view of a sub ink tank ST (a spare ink tank SST) that illustrates a state after ink in the sub ink tank ST (the spare ink tank SST) is flowed out.

Hereinafter, a configuration example of the ink refill unit 35 according to the present embodiment will be described with reference to FIG. 3 and FIG. 4. FIG. 3 is a diagram that illustrates a configuration example of the ink refill unit 35. FIG. 4 is a schematic side view of the sub ink tank ST (or the spare ink tank SST) that illustrates a state after ink in the sub ink tank ST (or the spare ink tank SST) is flowed out.

The ink refill unit 35 according to the present embodiment supplies ink to the head unit 30, and is provided for each color of ink. Specifically, each of the ink refill units 35 refills the corresponding head 31 with a different color of ink. For example, a white ink refill unit is provided to refill with white color ink, a cyan ink refill unit is provided to refill with cyan color ink, a magenta ink refill unit is provided to refill with magenta color ink, a yellow ink refill unit is provided to refill with yellow color ink, and a black ink refill unit is provided to refill with black color ink. Since each of the ink refill units 35 has a similar configuration, the white ink refill unit 35 that supplies white ink (W) will be explained as an example hereinafter. White ink is water-based ink that contains white color titanium oxide (titanium dioxide) as a pigment, and is used for printing a background color (white color) of a color image when printing is performed to a transparent medium.

As shown in FIG. 3, the ink refill unit 35 has the ink cartridge IC, the sub ink tank ST, the spare ink tank SST, an ink supply tube 34, a first ink supply tube 36, a second ink supply tube 37, and a supply pump P. The sub ink tank ST is an example of the first liquid reservoir section, and the spare ink tank SST is an example of the second liquid reservoir section. The ink supply tube 34 flows ink, flowed out of the ink cartridge IC, to the sub ink tank ST. The first ink supply tube 36 is an example of the supply passage that connects the sub ink tank ST and the head unit 30, and the second ink supply tube 37 connects the first ink supply tube 36 and the spare ink tank SST. The supply pump P is an example of a liquid supply section.

The ink cartridge IC stores ink to be supplied to the head unit 30. The ink cartridge IC is configured such that it can be attached to or removed from the main body of the printer.

The sub ink tank ST temporarily stores ink to be supplied from the ink cartridge IC to the head unit 30. Unlike the ink cartridge IC, since the sub ink tank ST is fixed to the inside of the printer, the sub ink tank ST is configured such that it cannot be removed from the main body of the printer.

Here, if ink stored in the sub ink tank ST is left for a long period of time, there are cases where sedimentation of ink occurs. Such sedimentation causes a difference in concentration between the upper side and the lower side of the sub ink tank ST in the vertical direction. In particular, in a case of pigment ink such as white ink, the difference in concentration due to segmentation will notably occur. Further, if an image is printed with ink after such segmentation, the density of the image will gradually change so as to be different from the density of the initial image as time passes, which causes deterioration in the quality of the printing.

In order to address this situation, according to the present embodiment, ink that has undergone segmentation in the sub ink tank ST is stirred by moving the ink back and forth between the sub ink tank ST and the spare ink tank SST so as to improve the uniformity of the ink concentration. An example of the operation for stirring ink will be described in detail later.

Also, since the sub ink tank ST is flexible, the sub ink tank ST can warp corresponding to the amount of stored ink. Specifically, the sub ink tank ST can deform flexibly while maintaining rigidity to some extent, and for example, the sub ink tank ST expands as ink is filled inside and contracts as ink is released outside. Therefore, in the stirring operation of ink described below, the sub ink tank ST deforms to be a collapse state as shown in FIG. 4 when it is aspirated by the supply pump P. In this manner, all the ink stored in the sub ink tank ST can be flowed out by deforming the sub ink tank ST to be a collapse state. If air enters the sub ink tank ST in such an instance, air is also flowed out of the sub ink tank ST as the ink is aspirated by the supply pump P.

The sub ink tank ST according to the present embodiment is formed in a bag shape with polyethylene-based resin of a transparent color. Here, it is not limited to polyethylene-based resin, and the sub ink tank ST may be formed in a bag shape with other resin, silicon or metal such as aluminum that has flexibility.

The spare ink tank SST temporarily stores ink, flowed out of the sub ink tank ST, to be sent back to the sub ink tank ST.

As described above, ink stored in the sub ink tank ST undergoes sedimentation after a long period of time passes, which causes a difference in concentration between the upper side and the lower side of the sub ink tank ST in the vertical direction. In such a case, ink stored in the sub ink tank ST is sequentially sent out toward the spare ink tank SST by the supply pump P. The spare ink tank SST allows the ink sent out from the sub ink tank ST to flow thereinto one after another, and can store the ink temporarily. Then, the ink stored in the spare ink tank SST is sent back to the sub ink tank ST by the supply pump P.

In this manner, ink that has undergone segmentation is stirred by moving the ink back and forth between the sub ink tank ST and the spare ink tank SST, so that the uniformity of the ink concentration can be improved.

Similarly to the sub ink tank ST, the spare ink tank SST is flexible. Therefore, the spare ink tank SST can warp corresponding to the amount of stored ink. The spare ink tank SST can also deform to be a collapse state as shown in FIG. 4 when it is aspirated by the supply pump P in the stirring operation of ink described below.

As shown in FIG. 3, the first ink supply tube 36 forms a flow passage through which ink flows from the sub ink tank ST to the head unit 30. A valve 36V is provided in the flow passage.

In the present embodiment, as shown in FIG. 3, four first ink supply tubes 361-364 are provided as flow passages for flowing white ink therethrough. Each tube connects the sub ink tank ST and the head unit 30 with respect to each other. The reason why four first ink supply tubes 361-364 are provided is because the carriage 42 of the present embodiment has the four sub carriages, the plurality of heads 31 are provided in each of the sub carriages, and white ink is supplied to each of the heads 31 by making the ink supply tube correspond to each of the sub carriages.

The valve 36V is an on-off valve for opening or closing the flow passage of the first ink supply tube 36. The valve 36V performs the opening or closing operation based on a control signal from the controller 60 when ink is moved between the sub ink tank ST and the spare ink tank SST, for example.

In the present embodiment, as shown in FIG. 3, upstream valves 36V1-36V4 are provided corresponding to the plurality of first ink supply tubes 361-364, respectively.

As shown in FIG. 3, the second ink supply tube 37 forms a flow passage that connects the first ink supply tube 36 and the spare ink tank SST. A valve 37V and the supply pump P are provided in the flow passage.

In the present embodiment, as shown in FIG. 3, four second ink supply tubes 371-374 are provided as flow passages for flowing white ink therethrough. The sub ink tank ST and the spare ink tank SST can be coupled with respect to each other by connecting the second ink supply tubes 371-374 with the first ink supply tubes 361-364 through connectors C1-C4.

The valve 37V is an on-off valve for opening or closing the flow passage of the second ink supply tube 37. The valve 37V performs the opening or closing operation based on a control signal from the controller 60 when ink is moved between the sub ink tank ST and the spare ink tank SST, for example.

In the present embodiment, as shown in FIG. 3, valves 37V1-37V4 are provided corresponding to the plurality of second ink supply tubes 371-374, respectively.

The supply pump P supplies compressed air so as to move ink back and forth between the sub ink tank ST and the spare ink tank SST. Specifically, the supply pump P supplies compressed air in response to a control signal from the controller 60, so as to aspirate ink in the sub ink tank ST and send out the ink to the spare ink tank SST, and aspirate the ink in the spare ink tank SST and send the ink back to the sub ink tank ST.

As shown in FIG. 3, the supply pump P according to the present embodiment has a first supply pump P1 and a second supply pump P2. The first supply pump P1 aspirates ink in the sub ink tank ST and sends out the ink to the spare ink tank SST. The second supply pump P2 aspirates ink in the spare ink tank SST and sends the ink back to the sub ink tank ST. Also, the first supply pump P1 is disposed in the flow passage that is formed by connecting the first ink supply tubes 361 and 364, and the second ink supply tubes 371 and 374. The second supply pump P2 is disposed in the flow passage that is formed by connecting the first ink supply tubes 362 and 363, and the second ink supply tubes 372 and 373.

As described above, in the ink refill unit 35 according to the present embodiment, the flow passage formed by connecting the first ink supply tubes 361 and 364 and the second ink supply tubes 371 and 374 forms a flow passage exclusive for sending out that is provided to send out ink from the sub ink tank ST to the spare ink tank SST (the outgoing passage). On the other hand, the flow passage formed by connecting the second ink supply tubes 372 and 373 and the first ink supply tubes 362 and 363 forms a flow passage exclusive for sending back that is provided to send ink from the spare ink tank SST back to the sub ink tank ST (the return passage).

Parts of the first ink supply tubes 361-364 on the sub ink tank ST side with respect to the connectors C1-C4 to which the second ink supply tubes 371-374 are connected are used for moving ink back and forth between the sub ink tank ST and the spare ink tank SST, and also used for refilling the head unit 30 with ink from the sub ink tank ST. Therefore, the parts of the first ink supply tubes 361-364 serve as shared passages.

Stirring Operation of Printer 1

Next, explanations will be made on an example of the operation for stirring ink that has undergone segmentation in the sub ink tank ST.

If ink stored in the sub ink tank ST is left for a long period of time without being used, sedimentation of ink will occur. In order to address such sedimentation, the printer 1 according to the present embodiment performs the stirring operation of stirring ink that has undergone segmentation by moving the ink back and forth between the sub ink tank ST and the spare ink tank SST so as to improve the uniformity of the concentration of the ink stored in the sub ink tank ST.

Similarly, if the ink cartridge IC is left unused for a long period of time, sedimentation of ink will occur. Since the ink cartridge IC is configured such that it can be attached to or removed from the main body of the printer, a user can perform a stirring operation by removing the ink cartridge IC from the main body of the printer and shaking it up and down so as to improve the uniformity of the concentration of the ink stored in the ink cartridge IC.

However, there are cases where air (air bubbles) enters the sub ink tank ST through the ink supply tube 34 connected to the ink cartridge IC when a user attaches the ink cartridge IC to the main body of the printer after stirring the ink cartridge IC. Although the amount of air (air bubbles) that enters at the time of attaching the ink cartridge IC is small, a large amount of air will be accumulated in the sub ink tank ST by repeating attachment and removal of the ink cartridge IC over and over again.

Further, when ink is moved (stirred) back and forth between the sub ink tank ST and the spare ink tank SST in a state where air (air bubbles) enters the sub ink tank ST, the air (air bubbles) will remain in the ink supply tube 36. The remaining air (air bubbles) flows through the ink supply tube 36 together with ink at the time of refilling the head unit 30 (the head 31) with ink, and eventually reaches the inside of the head unit 30. As a result, the air (air bubbles) causes discharge failure and causes deterioration in a printed image when the head unit 30 discharges ink.

In order to address this situation, the printer 1 of the present embodiment performs a post-stirring operation that flows out part of ink in the sub ink tank ST toward the first ink supply tube 36 (the shared passage) after performing the stirring process of stirring ink. With this, even if the operation of stirring ink is performed in a state where air enters the sub ink tank ST, the air (air bubbles) can be prevented from entering at the time of refilling the head unit 30 (the head 31) with ink.

Hereinafter, the stirring process of the present embodiment will be explained, and then the post-stirring process will be explained.

Stirring Process

Figure 5A:
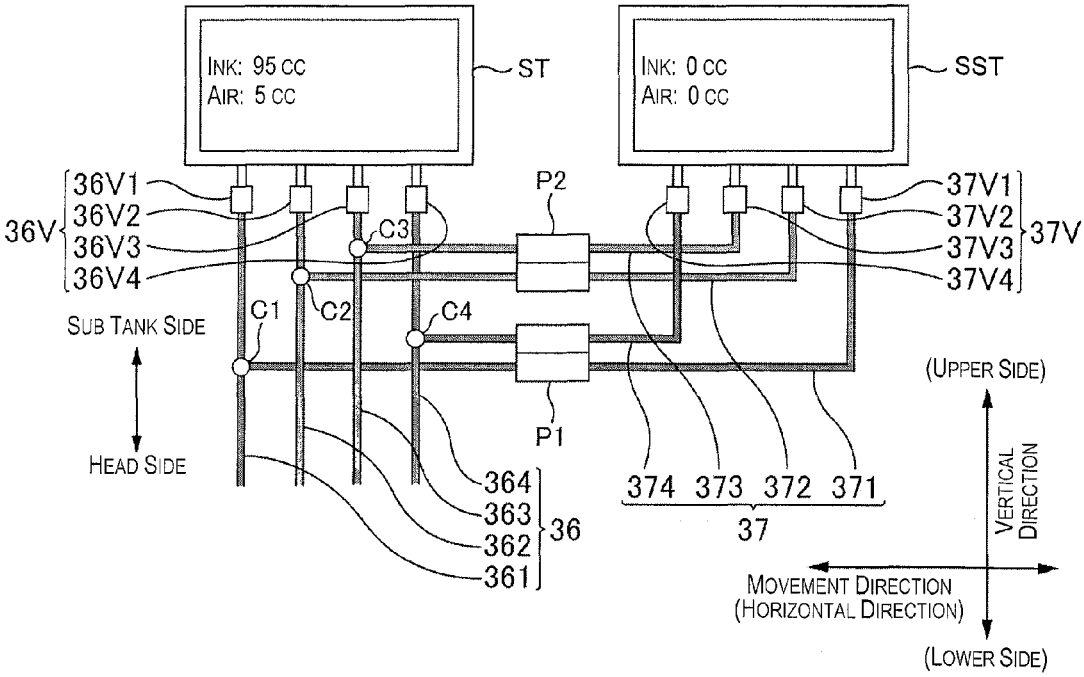
FIG. 5A is a diagram that explains a stirring process in the present embodiment and illustrates a state before sending out ink from the sub ink tank ST to the spare ink tank SST is started.
Figure 5B:
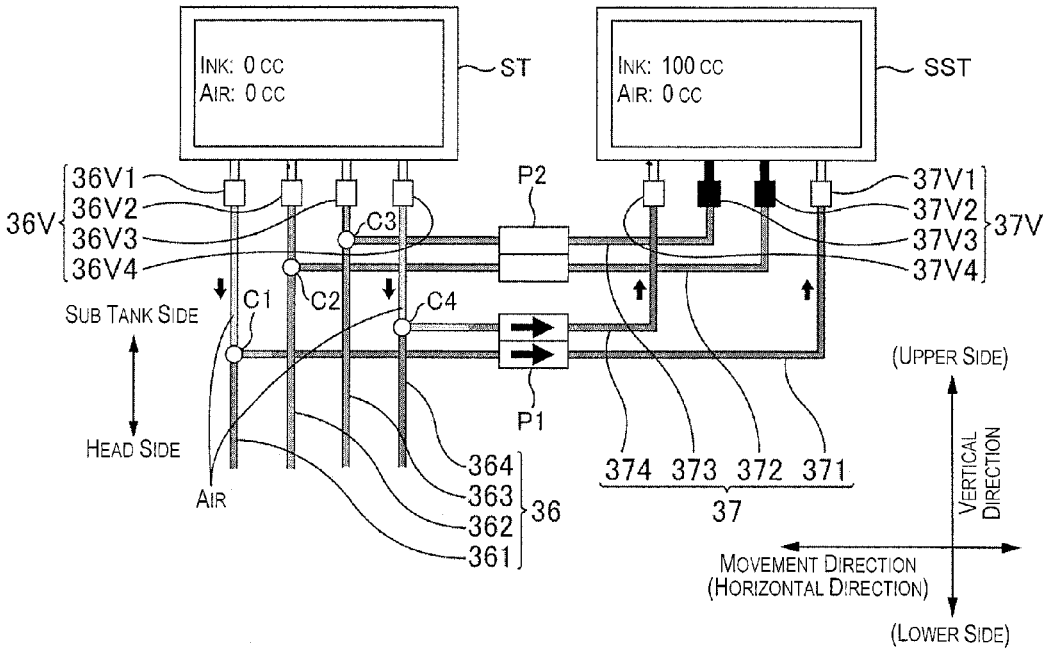
FIG. 5B is a diagram that explains the stirring process in the present embodiment and illustrates a state in which ink is flowed from the sub ink tank ST to the spare ink tank SST.
Figure 5C:
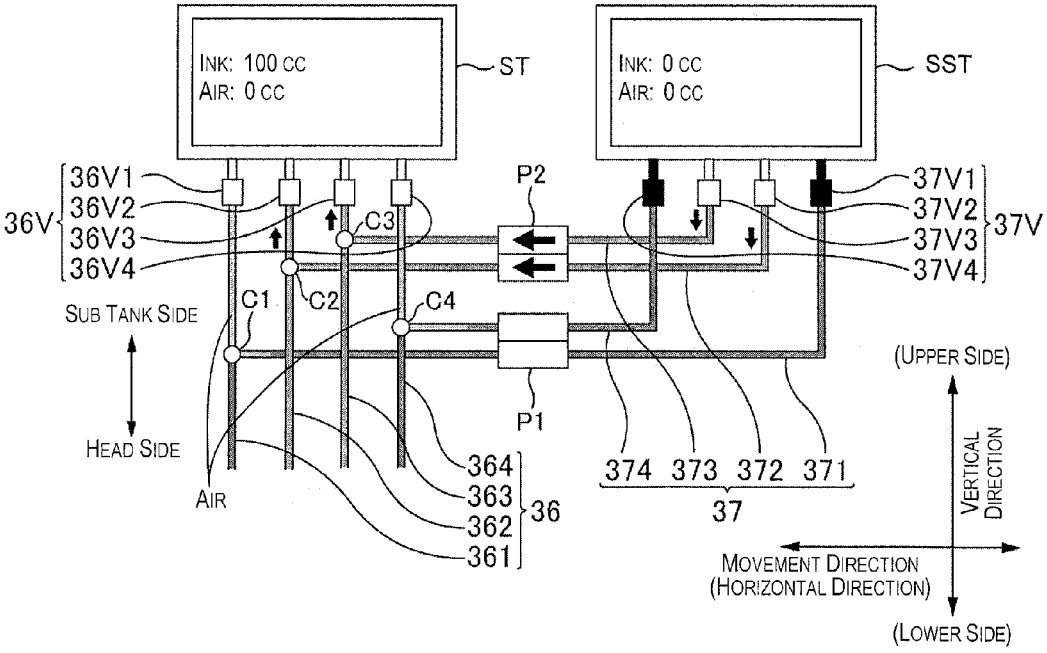
FIG. 5C is a diagram that explains the stirring process in the present embodiment and illustrates a state in which ink is flowed from the spare ink tank SST to the sub ink tank ST.

The process of stirring ink in the sub ink tank ST in a state where air (air bubbles) enters the sub ink tank ST will be explained with reference to FIG. 5A to FIG. 5C. FIG. 5A to FIG. 5C are diagrams that explain the stirring process in the present embodiment. Here, the volume of the flow passage (the outgoing passage and the return passage) between the sub ink tank ST and the spare ink tank SST is 10 cc.

FIG. 5A is a diagram that illustrates a state before sending out ink from the sub ink tank ST to the spare ink tank SST is started. Specifically, before the stirring process is started, 95 cc of ink and 5 cc of air are stored in the sub ink tank ST. Due to sedimentation of ink before starting the stirring process, there is a difference in concentration between the upper side and the lower side of the sub ink tank ST. The spare ink tank SST is in a state where neither ink nor air is stored (hereinafter, referred to as "hollow state"). The first ink supply tube 36 and the second ink supply tube 37 are filled with ink, respectively. The ink stirring process is started in this state. Hereinafter, the details will be described.

First, as shown in FIG. 5B, the controller 60 sequentially sends out ink in the sub ink tank ST toward the spare ink tank SST by driving only the first supply pump P1 in a state of closing the valves 37V2 and 37V3, and opening the valve 36V, the valves 37V1 and 37V4. Then, ink flowed out of the sub ink tank ST flows to the second ink supply tubes 374 and 371, respectively, via the first ink supply tubes 361 and 364 (that is, flows through the outgoing passage), and is stored in the spare ink tank SST one after another. After all the ink is flowed out, air is flowed out from the sub ink tank ST to the first ink supply tubes 361 and 364 at the end. In the present embodiment, driving of the first supply pump P1 is continued until the sub ink tank ST is put into a collapse state (see FIG. 4), and thus all the ink and air in the sub ink tank ST are flowed out. As a result, since both of the ink and air in the sub ink tank ST become 0 cc, the sub ink tank ST becomes a hollow state. Also, since 10 cc of ink existing in the outgoing passage is washed away and is stored in the spare ink tank SST, 100 cc of ink in total with 90 cc of ink flowed out of the sub ink tank ST is filled in the spare ink tank SST. Then, 5 cc of ink and 5 cc of air (air bubbles), flowed out of the sub ink tank ST, remain in the outgoing passage through which ink flows from the sub ink tank ST to the spare ink tank SST.

Next, as shown in FIG. 5C, the controller 60 sequentially sends ink in the spare ink tank SST back to the sub ink tank ST by driving only the second supply pump P2 in a state of closing the valves 37V1 and 37V4, and opening the valve 36V, the valves 37V2 and 37V3. Then, ink flowed out of the spare ink tank SST flows to the first ink supply tubes 362 and 363, respectively, via the second ink supply tubes 372 and 373 (that is, flows through the return passage), and is stored in the sub ink tank ST one after another. In the present embodiment, driving of the second supply pump P2 is continued until the spare ink tank SST is put into a collapse state (see FIG. 4), and thus all the ink in the spare ink tank SST is flowed out. As a result, since the ink in the spare ink tank SST becomes 0 cc, the spare ink tank SST becomes a hollow state. Also, since 10 cc of ink existing in the return passage is washed away and is stored in the sub ink tank ST, 100 cc of ink in total with 90 cc of ink flowed out of the spare ink tank SST is filled in the sub ink tank ST. Then, the return passage through which ink flows from the spare ink tank SST to the sub ink tank ST is filled with 10 cc of ink that has been flowed out of the spare ink tank SST. On the other hand, air (air bubbles) still remains in the outgoing passage.

In this manner, ink that has undergone segmentation in the sub ink tank ST is stirred by moving the ink back and forth between the sub ink tank ST and the spare ink tank SST so as to improve the uniformity of the ink concentration.

However, when the head unit 30 (the head 31) is tried to be refilled by flowing ink in the sub ink tank ST to the first ink supply tubes 361-364 after the stirring process, since air (air bubbles) remains in the first ink supply tubes 361 and 364 that form the outgoing passage, the air (air bubbles) is pushed by the flow of ink so as to flow toward the head, and eventually reaches the head unit 30 (the head 31). Consequently, it is likely that the air (air bubbles) will cause discharge failure and cause deterioration in a printed image when the head unit 30 discharges ink.

Therefore, the printer 1 according to the present embodiment subsequently performs the post-stirring process as described below.

Post-Stirring Process

Next, the post-stirring process will be explained with reference to FIG. 5D to FIG. 5G. FIG. 5D to FIG. 5G are diagrams that explain the post-stirring process in the present embodiment. The post-stirring process is performed subsequent to the above-described stirring process, which means that the post-stirring process is started in a state shown in FIG. 5C. Hereinafter, the details will be described.

Figure 5D:
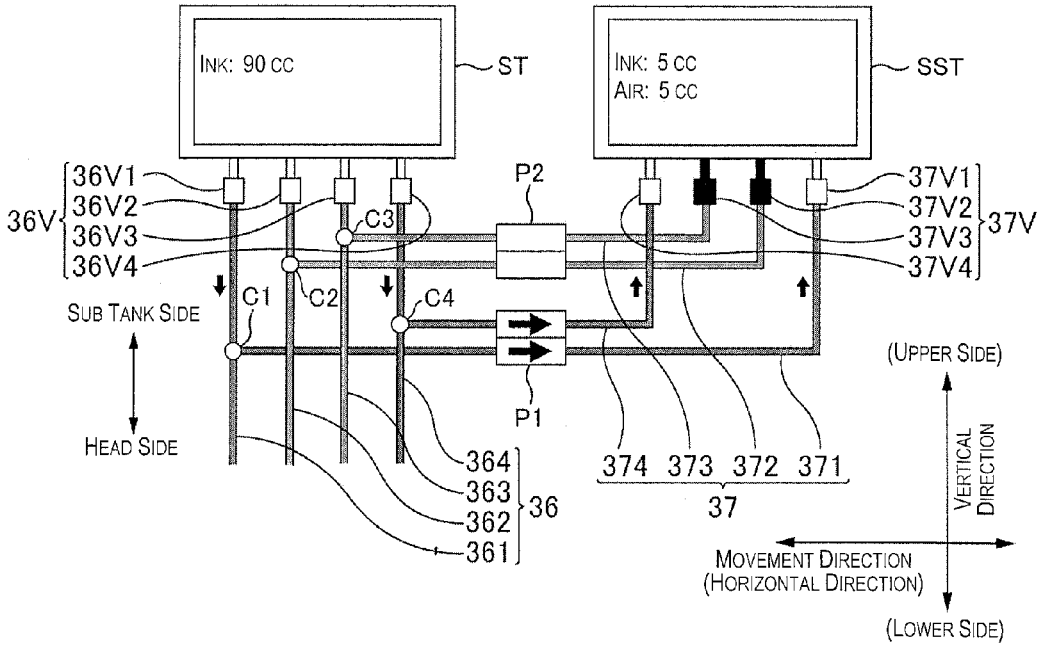
FIG. 5D is a diagram that explains the stirring process in the present embodiment and illustrates a state in which ink is flowed from the sub ink tank ST to the spare ink tank SST for a second time.

Subsequently, as shown in FIG. 5D, the controller 60 sequentially sends out ink in the sub ink tank ST toward the spare ink tank SST by driving only the first supply pump P1 in a state of closing the valves 37V2 and 37V3, and opening the valve 36V, the valves 37V1 and 37V4 for a second time. Then, ink flowed out of the sub ink tank ST flows to the second ink supply tubes 374 and 371, respectively, via the first ink supply tubes 361 and 364 (that is, flows through the outgoing passage), and is stored in the spare ink tank SST one after another. In such an instance, the controller 60 sends out part of ink in the sub ink tank ST by driving the first supply pump P1. In the present embodiment, 10 cc of ink out of 100 cc of ink stored in the sub ink tank ST is flowed out. As a result, 90 cc of ink remains in the sub ink tank ST because 10 cc of ink is flowed out. Also, 5 cc of ink and 5 cc of air (air bubbles), existing in the outgoing passage, is washed away and is stored in the spare ink tank SST. Then, the outgoing passage through which ink flows from the sub ink tank ST to the spare ink tank SST is filled with 10 cc of ink that has been flowed out of the sub ink tank ST.

The case where 10 cc of ink is flowed out from the sub ink tank ST by driving the first supply pump P1 is explained in the above. However, the present invention is not limited to this. For example, an amount of ink to fill with the shared passages of the first ink supply tubes 361-364 (parts on the sub ink tank ST side with respect to the connectors C1-C4) may be flowed out. With this, air (air bubbles) can be prevented from remaining in the shared passages of the first ink supply tubes 361-364.

Figure 5E:
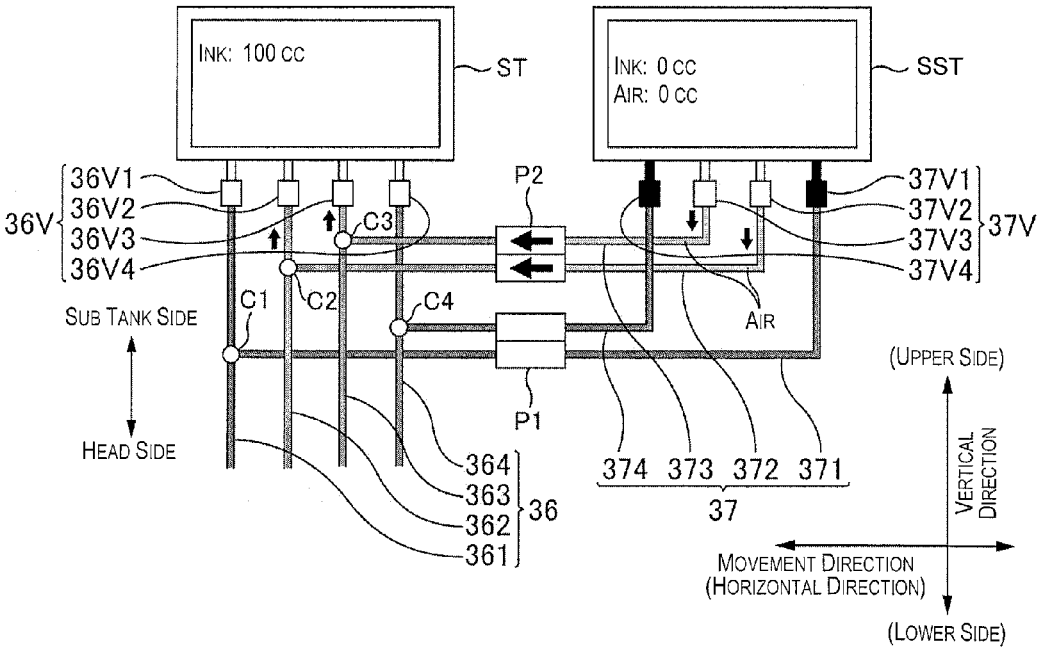
FIG. 5E is a diagram that explains the stirring process in the present embodiment and illustrates a state in which ink is flowed from the spare ink tank SST to the sub ink tank ST for a second time.

Next, as shown in FIG. 5E, the controller 60 sequentially sends ink in the spare ink tank SST back to the sub ink tank ST by driving only the second supply pump P2 in a state of closing the valves 37V1 and 37V4, and opening the valve 36V, the valves 37V2 and 37V3. Then, ink flowed out of the spare ink tank SST flows to the first ink supply tubes 362 and 363, respectively, via the second ink supply tubes 372 and 373 (that is, flows through the return passage). In the present embodiment, driving of the second supply pump P2 is continued until the spare ink tank SST is put into a collapse state (see FIG. 4), and thus all the ink and air in the spare ink tank SST are flowed out. As a result, since both of the ink and air in the spare ink tank SST become 0 cc, the spare ink tank SST becomes a hollow state. Also, since 10 cc of ink existing in the return passage is washed away and is stored in the sub ink tank ST, 100 cc of ink in total with 90 cc of ink already existing in the sub ink tank ST is filled in the sub ink tank ST. Then, the return passage through which ink flows from the spare ink tank SST to the sub ink tank ST is filled with 5 cc of ink and 5 cc of air (air bubbles) that have been flowed out of the spare ink tank SST. That is, air (air bubbles) remains in the return passage.

Figure 5F:
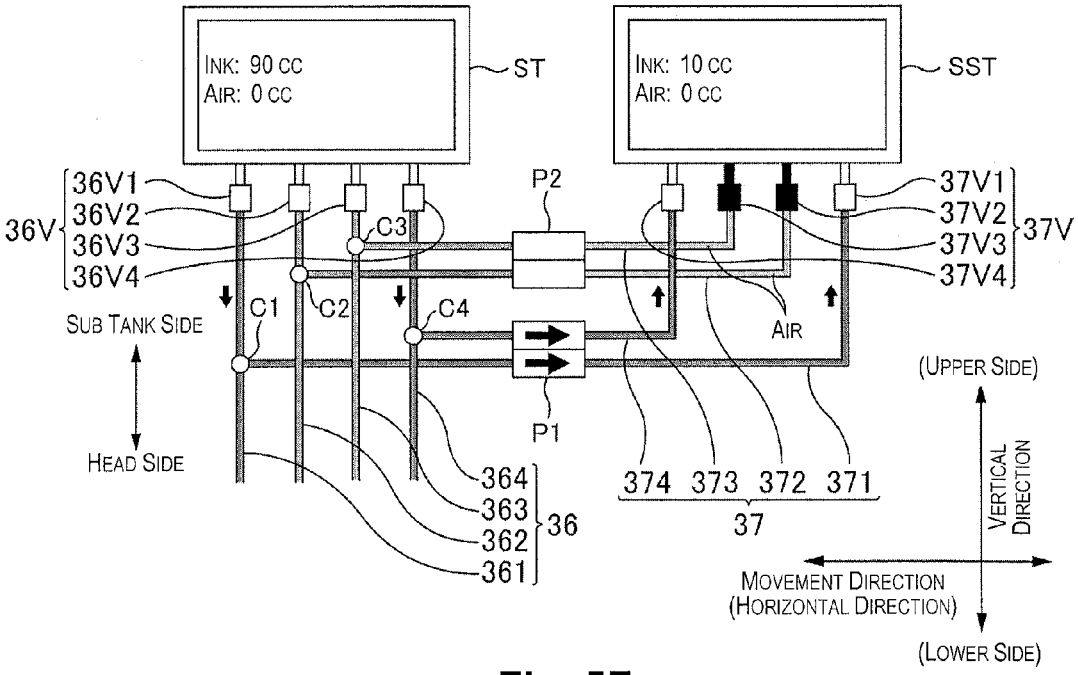
FIG. 5F is a diagram that explains the stirring process in the present embodiment and illustrates a state in which ink is flowed from the sub ink tank ST to the spare ink tank SST for a third time.

Next, as shown in FIG. 5F, the controller 60 sequentially sends out ink in the sub ink tank ST toward the spare ink tank SST by driving only the first supply pump P1 in a state of closing the valves 37V2 and 37V3, and opening the valve 36V, the valves 37V1 and 37V4 for a third time. Then, ink flowed out of the sub ink tank ST flows to the second ink supply tubes 374 and 371, respectively, via the first ink supply tubes 361 and 364 (that is, flows through the outgoing passage). In such an instance, the controller 60 sends out part of ink in the sub ink tank ST by driving the first supply pump P1. In the present embodiment, 10 cc of ink out of 100 cc of ink stored in the sub ink tank ST is flowed out. As a result, 90 cc of ink remains in the sub ink tank ST because 10 cc of ink is flowed out. Also, 10 cc of ink, existing in the outgoing passage, is washed away and is stored in the spare ink tank SST. Then, the outgoing passage through which ink flows from the sub ink tank ST to the spare ink tank SST is filled with 10 cc of ink that has been flowed out of the sub ink tank ST. On the other hand, air (air bubbles) still remains in the return passage.

Figure 5G:
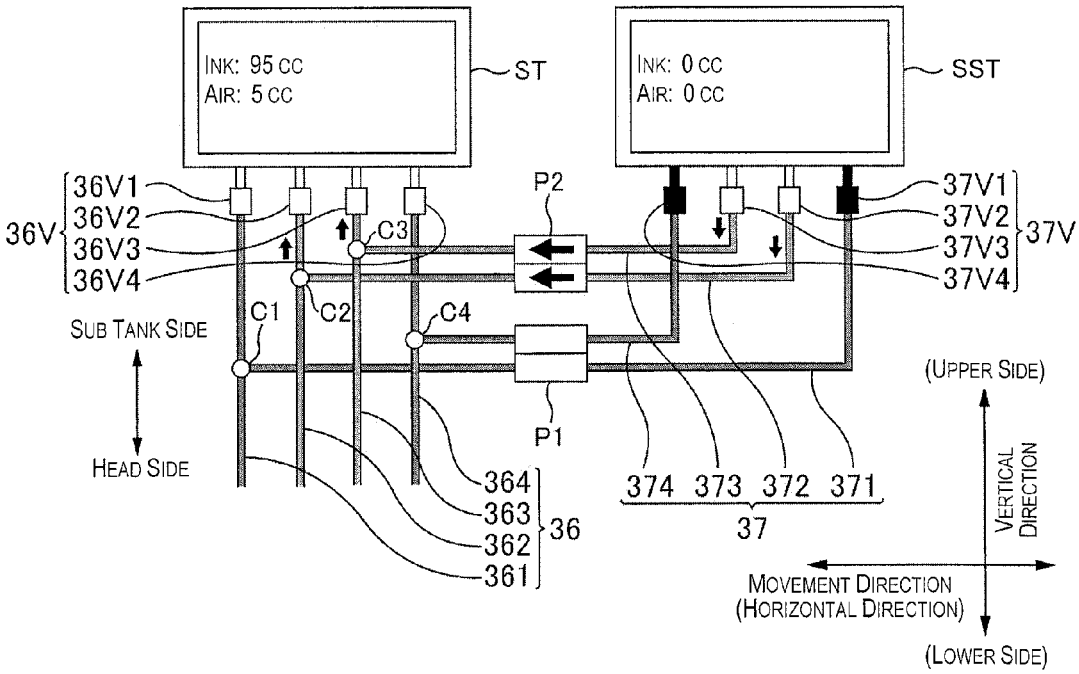
FIG. 5G is a diagram that explains the stirring process in the present embodiment and illustrates a state in which ink is flowed from the spare ink tank SST to the sub ink tank ST for a third time.

Next, as shown in FIG. 5G, the controller 60 sequentially sends ink in the spare ink tank SST back to the sub ink tank ST by driving only the second supply pump P2 in a state of closing the valves 37V1 and 37V4, and opening the valve 36V, the valves 37V2 and 37V3. Then, ink flowed out of the spare ink tank SST flows to the first ink supply tubes 362 and 363, respectively, via the second ink supply tubes 372 and 373 (that is, flows through the return passage). In the present embodiment, driving of the second supply pump P2 is continued until the spare ink tank SST is put into a collapse state (see FIG. 4), and thus all the ink in the spare ink tank SST is flowed out. As a result, since the ink in the spare ink tank SST becomes 0 cc, the spare ink tank SST becomes a hollow state. 5 cc of air (air bubbles) existing in the return passage is washed away, and is stored in the sub ink tank ST. 5 cc of ink existing in the return passage and 90 cc of ink already existing in the sub ink tank ST, which are 95 cc in total, are also filled in the sub ink tank ST. Then, the return passage through which ink flows from the spare ink tank SST to the sub ink tank ST is filled with 10 cc of ink that has been flowed out of the spare ink tank SST. That is, air (air bubbles) is sent back to the sub ink tank ST.

As described above, in the present embodiment, by subsequently performing the post-stirring process after the ink stirring process is performed, air flowed out of the sub ink tank ST is sent back to the sub ink tank ST, which can reduce air (air bubbles) remaining in the first ink supply tube 36 that forms the outgoing passage. Therefore, even if the head unit 30 (the head 31) is refilled by flowing ink in the sub ink tank ST to the first ink supply tube 36, air (air bubbles) can be prevented from flowing toward the head by being pushed due to the flow of ink. Consequently, air (air bubbles) can be prevented from entering when ink is supplied to the head unit 30.

Filling Operation of Printer 1

Hereinafter, a filling process (initial filling process) will be explained with reference to FIG. 6A to FIG. 6H. FIG. 6A to FIG. 6H are diagrams that explain the filling process in the present embodiment. Here, the volume of the flow passage between the sub ink tank ST and the spare ink tank SST is 10 cc. Also, the filling process is performed while the carriage 42 (the head unit 30) stops at the home position HP.

As described above, when ink is discharged from the head unit 30 (the head 31) and ink in the head unit 30 is consumed by performing image printing or the like, ink in the sub ink tank ST is flowed into the head unit 30 through the first ink supply tube 36 so as to compensate for the consumed ink. However, if the first ink supply tube 36 contains air (air bubbles), the air (air bubbles) flows into the head unit 30 together with ink, which may cause negative influence on image printing.

Also, if the second ink supply tube 37 contains air (air bubbles) as well as the first ink supply tube 36, the air (air bubbles) may flow into the first ink supply tube 36 by performing the above-described stirring process. When the air (air bubbles), that has flowed into the first ink supply tube 36, flows into the head unit 30 together with ink, it may cause negative influence on image printing.

In order to prevent this inconvenience from occurring, in the present embodiment, the ink filling process is performed such that the first ink supply tube 36 and the second ink supply tube 37 are filled with ink in advance, and no air (air bubbles) exists in the first ink supply tube 36 and the second ink supply tube 37. Hereinafter, the ink filling process will be described in detail.

Figure 6A:
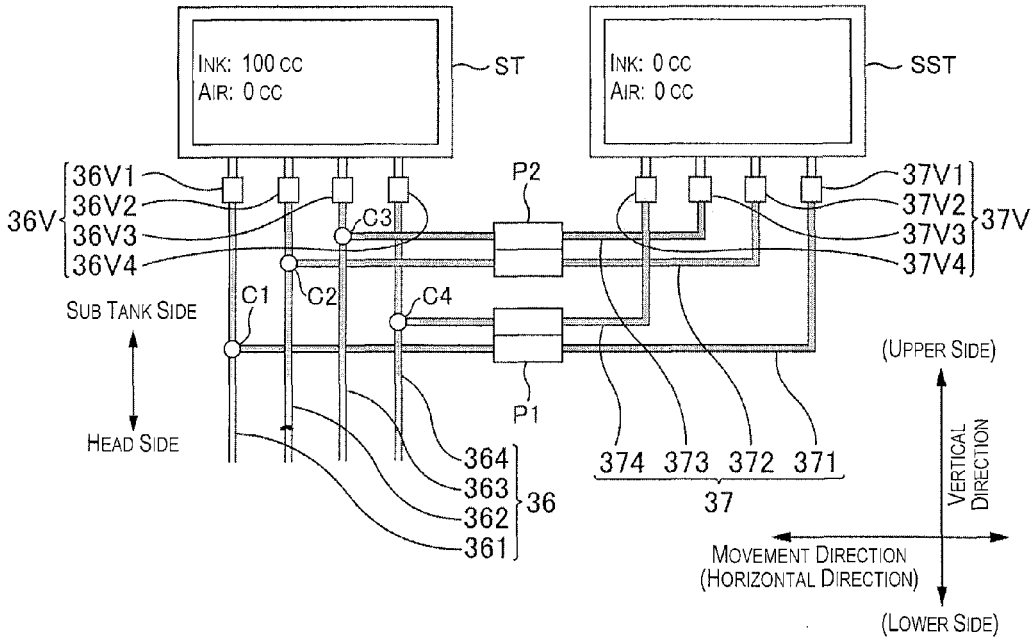
FIG. 6A is a diagram that explains a filling process in the present embodiment and illustrates a state before sending out ink from the sub ink tank ST to the spare ink tank SST is started.

As shown in FIG. 6A, 100 cc of ink supplied from the ink cartridge IC is stored in the sub ink tank ST before the ink filling process is started. The spare ink tank SST is in a hollow state. The first ink supply tube 36 and the second ink supply tube 37 are filled with air (air bubbles), respectively. The filling process is started in this state.

Figure 6B:
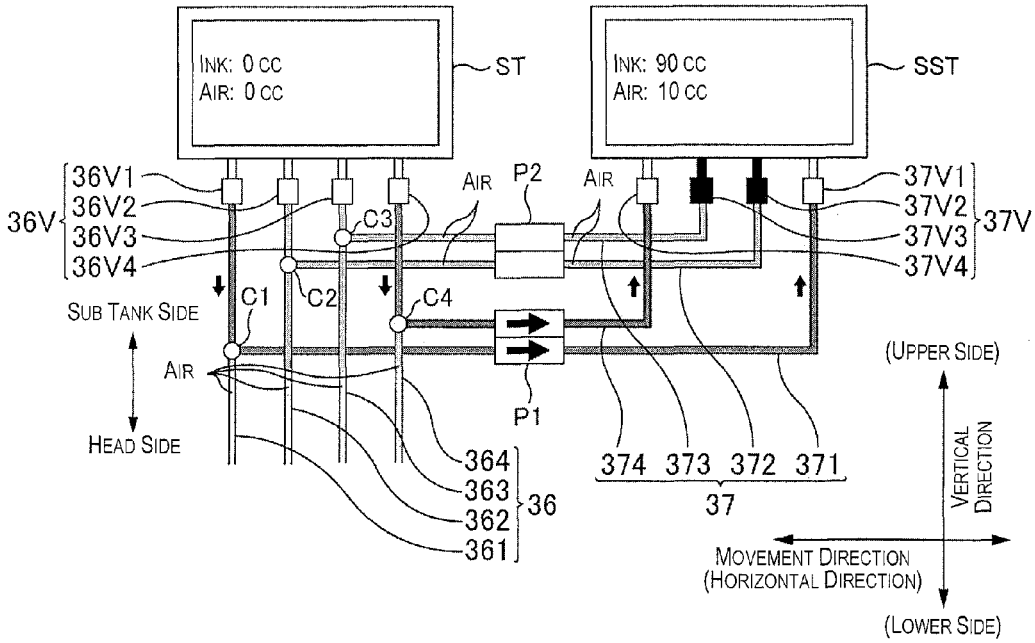
FIG. 6B is a diagram that explains the filling process in the present embodiment and illustrates a state in which ink is flowed from the sub ink tank ST to the spare ink tank SST.

First, as shown in FIG. 6B, the controller 60 sequentially sends out ink in the sub ink tank ST toward the spare ink tank SST by driving only the first supply pump P1 in a state of closing the valves 37V2 and 37V3, and opening the valve 36V, the valves 37V1 and 37V4. Then, ink flowed out of the sub ink tank ST flows to the second ink supply tubes 374 and 371, respectively, via the first ink supply tubes 361 and 364 (that is, flows through the outgoing passage), and is stored in the spare ink tank SST one after another. In the present embodiment, driving of the first supply pump P1 is continued until the sub ink tank ST is put into a collapse state (see FIG. 4), and thus all the ink in the sub ink tank ST is flowed out. As a result, since the ink in the sub ink tank ST becomes 0 cc, the sub ink tank ST becomes a hollow state. 10 cc of air existing in the outgoing passage is pushed by the flow of ink, and is stored in the spare ink tank SST. Also, 90 cc of ink flowed out of the sub ink tank ST is stored in the spare ink tank SST. Then, the outgoing passage through which ink flows from the sub ink tank ST to the spare ink tank SST is filled with 10 cc of ink flowed out of the sub ink tank ST (first process).

Figure 6C:
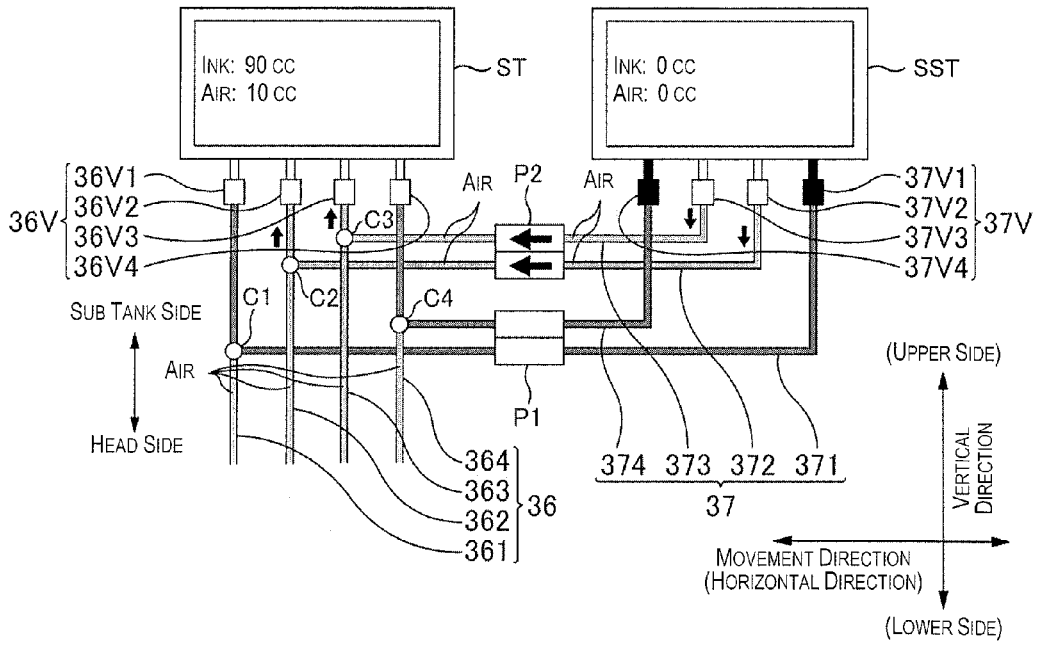
FIG. 6C is a diagram that explains the filling process in the present embodiment and illustrates a state in which ink is flowed from the spare ink tank SST to the sub ink tank ST.

Next, as shown in FIG. 6C, the controller 60 sequentially sends all the ink in the spare ink tank SST back to the sub ink tank ST by driving only the second supply pump P2 in a state of closing the valves 37V1 and 37V4, and opening the valve 36V, the valves 37V2 and 37V3 (second process). Then, ink flowed out of the spare ink tank SST flows to the first ink supply tubes 362 and 363, respectively, via the second ink supply tubes 372 and 373 (that is, flows through the return passage), and is stored in the sub ink tank ST one after another. In the present embodiment, driving of the second supply pump P2 is continued until the spare ink tank SST is put into a collapse state (see FIG. 4), and thus all the ink and air in the spare ink tank SST are flowed out. As a result, since both of the ink and air in the spare ink tank SST become 0 cc, the spare ink tank SST becomes a hollow state. 10 cc of air existing in the return passage is pushed by the flow of ink, and is stored in the sub ink tank ST. Also, 90 cc of ink flowed out of the spare ink tank SST is stored in the sub ink tank ST. Then, the return passage through which ink flows from the spare ink tank SST to the sub ink tank ST is filled with 10 cc of air (air bubbles) flowed out of the spare ink tank SST. That is, 10 cc of air (air bubbles) remains in the return passage.

When ink is moved back and forth between the sub ink tank ST and the spare ink tank SST, the outgoing passage is filled with ink, but the return passage is filled with air (air bubbles). If air (air bubbles) remains in the return passage, the air (air bubbles) might flow into the first ink supply tube 36 by performing the above-described ink stirring process. At the time of refilling the head unit 30 (the head 31) with ink, the air (air bubbles) flowing into the first ink supply tube 36 is pushed by the flow of ink so as to flow toward the head, and eventually reaches the head unit 30. Consequently, it is likely that the air (air bubbles) will cause discharge failure and cause deterioration in a printed image when the head unit 30 discharges ink. Therefore, the printer 1 according to the present embodiment performs a process of repeatedly flowing ink through the outgoing passage and the return passage as described below.

Figure 6D:
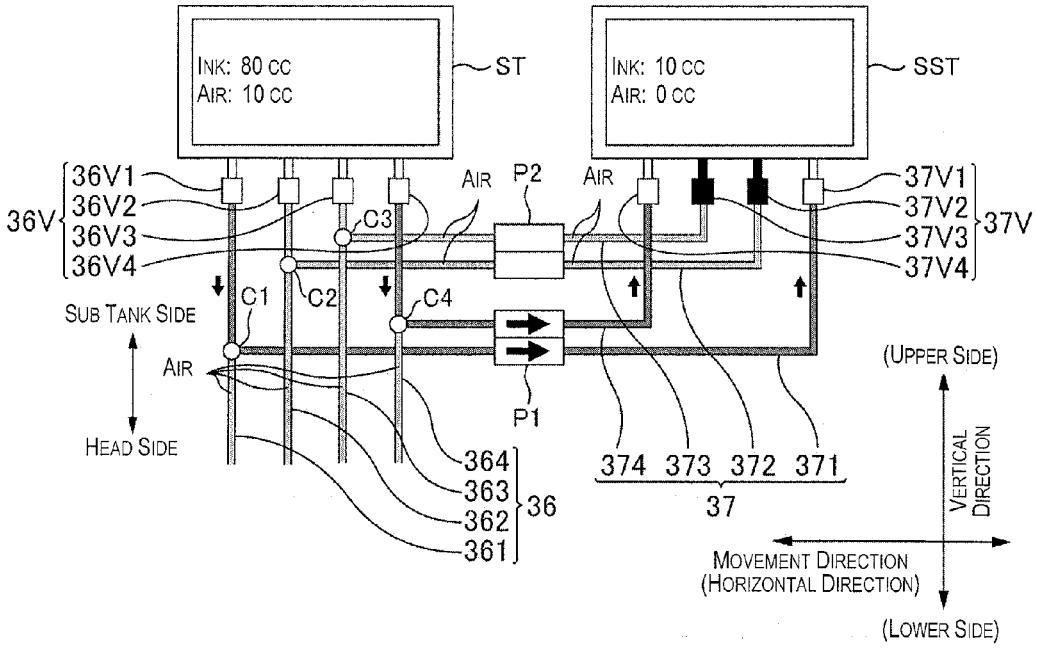
FIG. 6D is a diagram that explains the filling process in the present embodiment and illustrates a state in which ink is flowed from the sub ink tank ST to the spare ink tank SST for a second time.

Subsequently, as shown in FIG. 6D, the controller 60 sequentially sends out ink in the sub ink tank ST toward the spare ink tank SST by driving only the first supply pump P1 in a state of closing the valves 37V2 and 37V3, and opening the valve 36V, the valves 37V1 and 37V4 for a second time (third process). Then, ink flowed out of the sub ink tank ST flows to the second ink supply tubes 371 and 374, respectively, via the first ink supply tubes 361 and 364 (that is, flows through the outgoing passage). In such an instance, the controller 60 sends out part of ink in the sub ink tank ST by driving the first supply pump P1. In the present embodiment, 10 cc of ink out of 90 cc of ink stored in the sub ink tank ST (see FIG. 6C) is flowed out. As a result, 80 cc of ink and 10 cc of air remain in the sub ink tank ST because 10 cc of ink is flowed out. Also, 10 cc of ink existing in the outgoing passage is washed away, and is stored in the spare ink tank SST. Then, the outgoing passage is filled with 10 cc of ink that has been flowed out of the sub ink tank ST. 10 cc of air (air bubbles) still remains in the return passage.

Figure 6E:
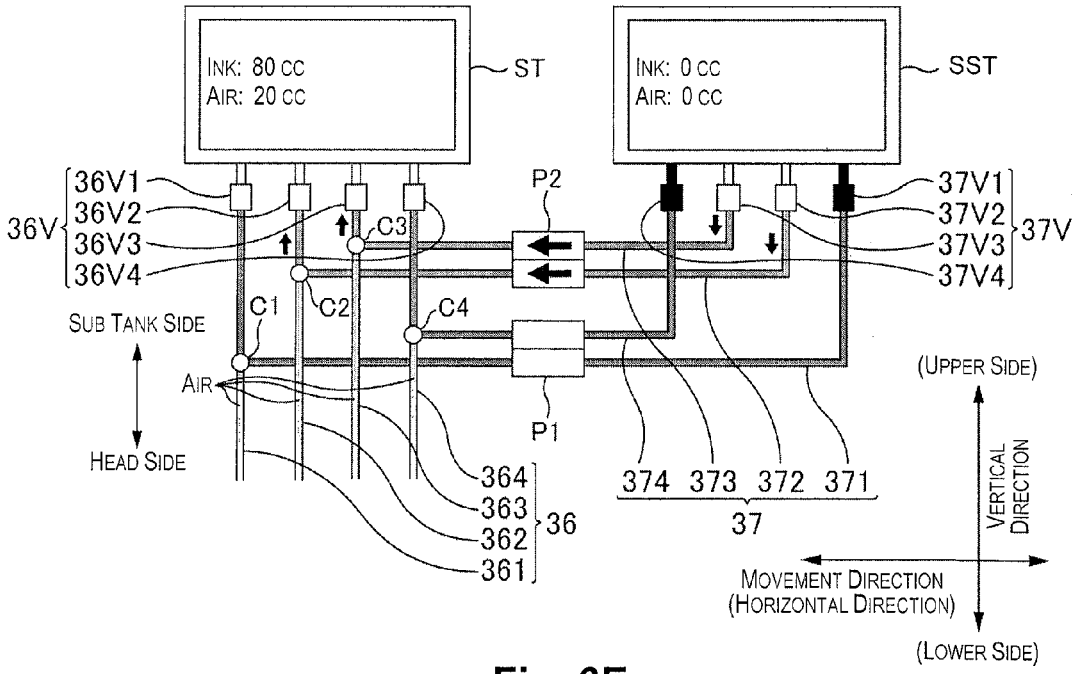
FIG. 6E is a diagram that explains the filling process in the present embodiment and illustrates a state in which ink is flowed from the spare ink tank SST to the sub ink tank ST for a second time.

Next, as shown in FIG. 6E, the controller 60 sequentially sends ink in the spare ink tank SST back to the sub ink tank ST by driving only the second supply pump P2 in a state of closing the valves 37V1 and 37V4, and opening the valve 36V, the valves 37V2 and 37V3 (fourth process). Then, ink flowed out of the spare ink tank SST flows to the first ink supply tubes 362 and 363, respectively, via the second ink supply tubes 372 and 373 (that is, flows through the return passage). In the present embodiment, driving of the second supply pump P2 is continued until the spare ink tank SST is put into a collapse state (see FIG. 4), and thus all the ink in the spare ink tank SST is flowed out. That is, since all of 10 cc of the ink in the spare ink tank SST is flowed out, all the air (air bubbles) remaining in the return passage can be washed away toward the sub ink tank ST. As a result, since the ink in the spare ink tank SST becomes 0 cc, the spare ink tank SST becomes a hollow state. Also, since all of 10 cc of the air remaining in the return passage is washed away and is stored in the sub ink tank ST, 20 cc of air in total with 10 cc of air already existing in the sub ink tank ST is filled in the sub ink tank ST. Further, 80 cc of ink already existing in the sub ink tank ST is stored in the sub ink tank ST. The return passage is filled with 10 cc of ink that has been flowed out of the spare ink tank SST.

As described above, by flowing ink through the outgoing passage and the return passage again, the air (air bubbles) remaining in the return passage is washed away, and is stored in the sub ink tank ST. Consequently, the return passage is filled with ink. Also, the outgoing passage is filled with ink.

Figure 6F:
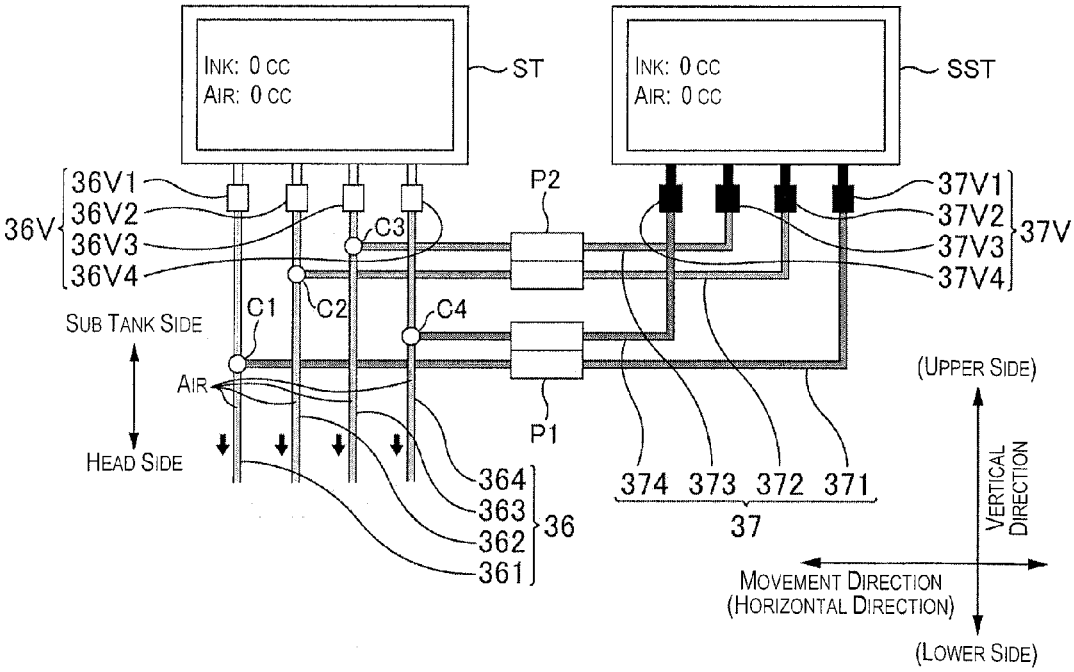
FIG. 6F is a diagram that explains the filling process in the present embodiment and illustrates a state in which ink is flowed from the sub ink tank ST to a head unit 30.

Next, as shown in FIG. 6F, the controller 60 flows ink and air in the sub ink tank ST to the first ink supply tube 36 by driving an aspiration pump (the cleaning unit 45) that is disposed on the head side but is not shown in the drawing in a state of closing the valve 37V and opening the valve 36V. In such an instance, driving of the aspiration pump that is not shown in the drawing is continued until the sub ink tank ST is put into a collapse state (see FIG. 4), and thus all the ink and air in the sub ink tank ST are flowed out. In this manner, ink and air flowing through the first ink supply tube 36 is ejected from the head 31 to the outside.

Figure 6G:
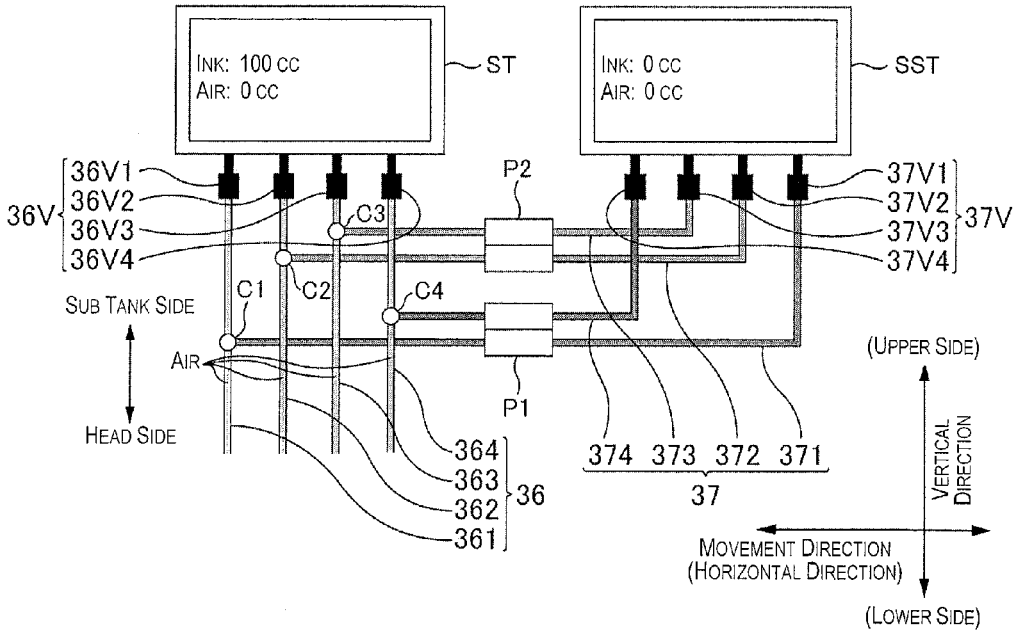
FIG. 6G is a diagram that explains the filling process in the present embodiment and illustrates a state in which ink is flowed from an ink cartridge IC to the sub ink tank ST.

Next, as shown in FIG. 6G, the controller 60 performs control to supply ink from the ink cartridge IC to the sub ink tank ST in a state of closing the valve 36V and the valve 37V. In the present embodiment, since 100 cc of ink is supplied from the ink cartridge IC to the sub ink tank ST, the sub ink tank ST is filled with ink.

Figure 6H:
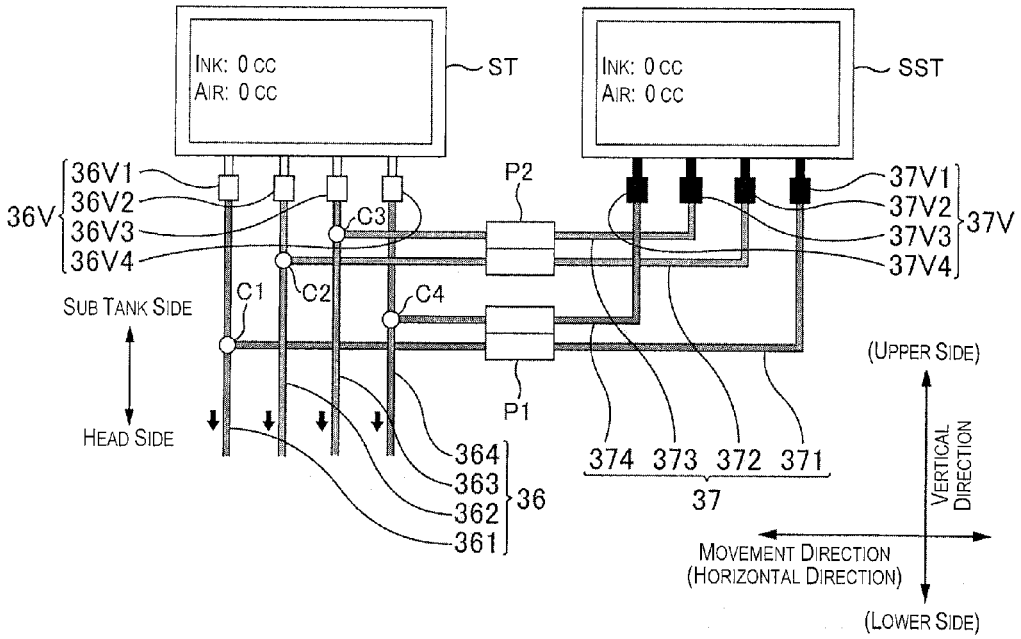
FIG. 6H is a diagram that explains the filling process in the present embodiment and illustrates a state in which ink is supplied from the sub ink tank ST to the head unit 30.

Next, as shown in FIG. 6H, the controller 60 performs control to flow ink in the sub ink tank ST to the first ink supply tube 36 in a state of opening the valve 36V so as to refill the head unit 30 (the head 31). With this, the first ink supply tube 36 is filled with ink.

As described above, in the present embodiment, by performing the filling process of filling the first ink supply tube 36 and the second ink supply tube 37 with ink, air (air bubbles) existing in the first ink supply tube 36 and the second ink supply tube 37 before the filling process is stored in the sub ink tank ST. Therefore, when the above-described stirring process is performed after the filling process, it is possible to decrease the likelihood that air (air bubbles) existing in the second ink supply tube 37 will flow into the first ink supply tube 36. As a result, air (air bubbles) can be prevented from entering when ink is supplied to the head unit 30.

Effectiveness of Printer 1 According to Present Embodiment

As described above, the printer 1 according to the present embodiment has the head unit 30 that discharges ink onto the roll paper 2, the sub ink tank ST that stores ink, the first ink supply tube 36 for supplying ink from the sub ink tank ST to the head unit 30, the spare ink tank SST that is used for storing ink sent out from the sub ink tank ST and sending the ink back to the sub ink tank ST, the outgoing passage (the first ink supply tubes 361 and 364, and the second ink supply tubes 371 and 374) through which ink passes when ink is sent from the sub ink tank ST to the spare ink tank SST, the outgoing passage including the shared passage that is shared with the first ink supply tube 36, the return passage (the first ink supply tubes 362 and 363, and the second ink supply tubes 372 and 373) through which ink passes when ink is sent from the spare ink tank SST to the sub ink tank ST, and the controller 60 that performs the stirring process of stirring ink by causing all ink in the sub ink tank ST to pass through the outgoing passage so as to be sent toward the spare ink tank SST and subsequently causing all ink in the spare ink tank SST to pass through the return passage so as to be sent toward the sub ink tank ST. The controller 60 performs the post-stirring process of flowing out part of ink in the sub ink tank ST toward the shared passage after performing the stirring process. With this, even if the stirring process of stirring ink is performed in a case where air enters the sub ink tank ST, the air (air bubbles) is sent back to the sub ink tank ST, and air (air bubbles) remaining in the first ink supply tube 36 can be reduced. Therefore, air (air bubbles) can be prevented from entering when ink is supplied to the head unit 30 after the stirring process.

Also, the controller 60 causes part of ink in the sub ink tank ST to flow out toward all the shared passage after performing the stirring process. With this, air (air bubbles) can be prevented from remaining in the shared passage, and air (air bubbles) can be prevented from entering more effectively when ink is supplied to the head unit 30 after the stirring process.

Also, the printer 1 according to the present embodiment has the head unit 30 that discharges ink onto the roll paper 2, the sub ink tank ST that stores ink, the first ink supply tube 36 for supplying ink from the sub ink tank ST to the head unit 30, the spare ink tank SST that is used for storing ink sent out from the sub ink tank ST and sending the ink back to the sub ink tank ST, the outgoing passage (the first ink supply tubes 361 and 364, and the second ink supply tubes 371 and 374) through which ink passes when ink is sent from the sub ink tank ST to the spare ink tank SST, the return passage (the first ink supply tubes 362 and 363, and the second ink supply tubes 372 and 373) through which ink passes when ink is sent from the spare ink tank SST to the sub ink tank ST, the return passage including the shared passage that is shared with the first ink supply tube 36, and the controller 60 that performs the filling process including the first process of filling the outgoing passage with ink by causing ink in the sub ink tank ST to pass through the outgoing passage so as to be sent toward the spare ink tank SST, the second process of causing all the ink stored in spare ink tank SST in the first process to pass through the return passage so as to be sent toward the sub ink tank ST, the third process of causing the ink in the sub ink tank ST to pass through the outgoing passage once again so as to be sent toward the spare ink tank SST, and the fourth process of filling the return passage with ink by causing the ink stored in the spare ink tank SST in the third process to pass through the return passage so as to be sent toward the sub ink tank ST. With this, when the above-described stirring process is performed, it is possible to decrease the likelihood that air (air bubbles) existing in the second ink supply tube 37 will flow into the first ink supply tube 36. Therefore, air (air bubbles) can be prevented from entering when ink is supplied to the head unit 30.

Other Embodiments

Although the liquid-discharging device is mainly described in the present embodiment, the liquid stirring method and the like is also disclosed. Further, the present embodiment is described for easy understanding of the present invention, and interpretation of the present invention is not limited to the present embodiment. It is apparent that changes and modifications of the present invention can be made without substantially departing from the subject matter of the present invention, and the present invention covers its equivalents. In particular, the present invention covers the embodiment described below.

In the above embodiments, the ink-jet printer was explained as an example of the liquid-discharging device. However, the present invention is not limited to this. For example, a liquid-discharging device for discharging liquid other than ink may be possible. The present invention can be used for various kinds of liquid-discharging devices provided with a liquid spray head or the like that discharges minute amounts of ink droplets. Here, ink droplets refer to a state of liquid discharged from the above-described liquid-discharging device, and include ones that trail in a grain shape, a tear shape, or a string shape. Also, it is sufficient for the liquid described here to be made of the material that can be discharged by the liquid-discharging device. For example, a material in a state of the liquid phase is sufficient, including a liquid body having high or low viscosity, sol, gel water, a fluid body such as an inorganic solvent, an organic solvent, a solution, liquid resin, liquid metal (metal melt), and one in which particles of a functional material consisting of a solid material such as a pigment or metal particles are dissolved, dispersed, or mixed into a solvent, as well as liquid as a state of a material. Also, as a representative example of liquid, ink described in the above embodiments, liquid crystal, and the like can be listed. Here, ink includes common water-based ink, oil-based ink, and various kinds of liquid compositions such as gel ink, hot melt ink, or the like. Specific examples of the liquid-discharging device include a liquid crystal display, an EL (electroluminescence) display, a surface emitting display, a liquid-discharging device that discharges liquid containing an electrode material or a color material used for manufacturing a color filter in a form of dispersion or dissolution, a liquid-discharging device that discharges a living organic material used for manufacturing a biochip, a liquid-discharging device that is used as precision pipette and discharges liquid serving as a sample, a printing device, a micro dispenser, and the like. Further, it is possible to employ a liquid-discharging device that discharges lubricant oil to a precision instrument such as a timepiece or a camera by pinpointing, a liquid-discharging device that discharges transparent resin liquid such as ultraviolet curable resin to a substrate for forming a hemispherical micro lens used for an optical communication device or the like, and a liquid-discharging device that discharges etching liquid such as acid or alkali for etching of a substrate or the like. The present invention can be applied to any one of the liquid-discharging devices.

Stirring Process and Filling Process

In the stirring process and the filling process of the above-described embodiments, the volumes of the sub ink tank ST and the spare ink tank SST are 100 cc, respectively, and the volumes of the outgoing passage and the return passage are 100 cc, respectively. However, these are not limited to these numerical values.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid-discharging device comprising:

a head section configured and arranged to discharge liquid onto a medium;

a first liquid reservoir section configured and arranged to store the liquid;

a supply passage configured and arranged to supply the liquid from the first liquid reservoir section to the head section;

a second liquid reservoir section configured and arranged to store the liquid sent out from the first liquid reservoir section and to send the liquid back to the first liquid reservoir section;

an outgoing passage through which the liquid passes when the liquid is sent from the first liquid reservoir section to the second liquid reservoir section, the outgoing passage including a shared passage that is shared with the supply passage;

a return passage through which the liquid passes when the liquid is sent from the second liquid reservoir section to the first liquid reservoir section; and a controller configured to perform a stirring process of stirring the liquid by causing the liquid in the first liquid reservoir section to pass through the outgoing passage so as to be sent toward the second liquid reservoir section and subsequently causing the liquid in the second liquid reservoir section, which has been sent from the first liquid reservoir section, to pass through the return passage, and return to and enter the first liquid reservoir section, the controller being configured to perform a process of flowing out a part of the liquid in the first liquid reservoir section, which has been sent from the first liquid reservoir section to the second liquid reservoir section and returned to the first liquid reservoir section, toward the shared passage after performing the stirring process.

2. The liquid-discharging device according to claim 1, wherein the controller is configured to flow out the part of the liquid in the first liquid reservoir section toward all the shared passage after performing the stirring process.

3. The liquid-discharging device according to claim 1, further comprising a first valve configured and arranged to open or close the outgoing passage, and a second valve configured and arranged to open or close the return passage, the first valve being attached to the outgoing passage closer to the second liquid reservoir section than to the first liquid reservoir section, the second valve being attached to the return passage closer to the second liquid reservoir section than to the first liquid reservoir section, the controller controlling the first valve and the second valve independently.

4. The liquid-discharging device according to claim 3, wherein the controller controls the first valve to close and controls the second valve to open while causing the liquid in the second liquid reservoir section, which has been sent from the first liquid reservoir section, to pass through the return passage, and return to and enter the first liquid reservoir section.

5. The liquid-discharging device according to claim 1, wherein the second liquid reservoir section is formed of a deformable material, and the second liquid reservoir section is deformed in a collapsed state in response to the controller causing the liquid in the second liquid reservoir section, which has been sent from the first liquid reservoir section, to pass through the return passage, and return to and enter the first liquid reservoir section.

6. A liquid-discharging device comprising:

a head section configured and arranged to discharge liquid onto a medium;

a first liquid reservoir section configured and arranged to store the liquid;

a supply passage configured and arranged to supply the liquid from the first liquid reservoir section to the head section;

a second liquid reservoir section configured and arranged to store the liquid sent out from the first liquid reservoir section and to send the liquid back to the first liquid reservoir section;

an outgoing passage through which the liquid passes when the liquid is sent from the first liquid reservoir section to the second liquid reservoir section;

a return passage through which the liquid passes when the liquid is sent from the second liquid reservoir section to the first liquid reservoir section, the return passage including a shared passage that is shared with the supply passage; and a controller configured to perform a filling process including a first process of filling the outgoing passage with the liquid by causing the liquid in the first liquid reservoir section to pass through the outgoing passage so as to be sent toward the second liquid reservoir section, a second process of causing the liquid stored in the second liquid reservoir section, which has been sent from the first liquid reservoir section in the first process, to pass through the return passage, and return to and enter the first liquid reservoir section, a third process of causing the liquid in the first liquid reservoir section, which has been sent from the first liquid reservoir section to the second liquid reservoir section and returned to the first liquid reservoir section, to pass through the outgoing passage once again so as to be sent toward the second liquid reservoir section, and a fourth process of filling the return passage with the liquid by causing the liquid stored in the second liquid reservoir section, which has been sent from the first liquid reservoir section in the third process, to pass through the return passage so as to be sent toward the first liquid reservoir section.

7. The liquid-discharging device according to claim 6, further comprising a first valve configured and arranged to open or close the outgoing passage, and a second valve configured and arranged to open or close the return passage, the first valve being attached to the outgoing passage closer to the second liquid reservoir section than to the first liquid reservoir section, the second valve being attached to the return passage closer to the second liquid reservoir section than to the first liquid reservoir section, the controller controlling the first valve and the second valve independently.

8. The liquid-discharging device according to claim 7, wherein the controller controls the first valve to close and controls the second valve to open while causing the liquid in the second liquid reservoir section, which has been sent from the first liquid reservoir section, to pass through the return passage, and return to and enter the first liquid reservoir section.

9. The liquid-discharging device according to claim 6, wherein the second liquid reservoir section is formed of a deformable material, and the second liquid reservoir section is deformed in a collapsed state in response to the controller causing the liquid in the second liquid reservoir section, which has been sent from the first liquid reservoir section, to pass through the return passage, and return to and enter the first liquid reservoir section.

10. A liquid stirring method comprising:

preparing a liquid-discharging device including a head section configured and arranged to discharge liquid onto a medium, a first liquid reservoir section configured and arranged to store the liquid, a supply passage configured and arranged to supply the liquid from the first liquid reservoir section to the head section, a second liquid reservoir section configured and arranged to store the liquid sent out from the first liquid reservoir section and to send the liquid back to the first liquid reservoir section, an outgoing passage through which the liquid passes when the liquid is sent from the first liquid reservoir section to the second liquid reservoir section, the outgoing passage including a shared passage that is shared with the supply passage, a return passage through which the liquid passes when the liquid is sent from the second liquid reservoir section to the first liquid reservoir section, and a controller;

performing, by the controller, a stirring process of stirring the liquid by causing the liquid in the first liquid reservoir section to pass through the outgoing passage so as to be sent toward the second liquid reservoir section and subsequently causing the liquid in the second liquid reservoir section, which has been sent from the first liquid reservoir section, to pass through the return passage, and return to and enter the first liquid reservoir section; and performing, by the controller, a process of flowing out a part of the liquid in the first liquid reservoir section, which has been sent from the first liquid reservoir section to the second liquid reservoir section and returned to the first liquid reservoir section, toward the shared passage after the performing of the stirring process.

11. A liquid filling method comprising:

preparing a liquid-discharging device including a head section configured and arranged to discharge liquid onto a medium, a first liquid reservoir section configured and arranged to store the liquid, a supply passage configured and arranged to supply the liquid from the first liquid reservoir section to the head section, a second liquid reservoir section configured and arranged to store the liquid sent out from the first liquid reservoir section and to send the liquid back to the first liquid reservoir section, an outgoing passage through which the liquid passes when the liquid is sent from the first liquid reservoir section to the second liquid reservoir section, a return passage through which the liquid passes when the liquid is sent from the second liquid reservoir section to the first liquid reservoir section, the return passage including a shared passage that is shared with the supply passage, and a controller; and performing a filling process by the controller, the filling process including a first process of filling the outgoing passage with the liquid by causing the liquid in the first liquid reservoir section to pass through the outgoing passage so as to be sent toward the second liquid reservoir section, a second process of causing the liquid stored in the second liquid reservoir section, which has been sent from the first liquid reservoir section in the first process, to pass through the return passage, and return to and enter the first liquid reservoir section, a third process of causing the liquid in the first liquid reservoir section, which has been sent from the first liquid reservoir section to the second liquid reservoir section and returned to the first liquid reservoir section, to pass through the outgoing passage once again so as to be sent toward the second liquid reservoir section, and a fourth process of filling the return passage with the liquid by causing the liquid stored in the second liquid reservoir section, which has been sent from the first liquid reservoir section in the third process, to pass through the return passage so as to be sent toward the first liquid reservoir section.

* * * * *